US008216754B2

(12) United States Patent
Ikeda et al.

(10) Patent No.: US 8,216,754 B2
(45) Date of Patent: Jul. 10, 2012

(54) ELECTROSTATIC-IMAGE-DEVELOPING TONER AND PREPARATION PROCESS THEREOF, ELECTROSTATIC IMAGE DEVELOPER, TONER CARTRIDGE, PROCESS CARTRIDGE, IMAGE FORMING METHOD AND IMAGE FORMING APPARATUS

(75) Inventors: Yusuke Ikeda, Kanagawa (JP); Susumu Yoshino, Kanagawa (JP); Masanobu Ninomiya, Kanagawa (JP); Yukiaki Nakamura, Kanagawa (JP); Yasuo Kadokura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 593 days.

(21) Appl. No.: 12/468,372

(22) Filed: May 19, 2009

(65) Prior Publication Data

US 2010/0104967 A1 Apr. 29, 2010

(30) Foreign Application Priority Data

Oct. 23, 2008 (JP) ..... 2008-272712

(51) Int. Cl.
*G03G 9/09* (2006.01)

(52) U.S. Cl. ..... 430/108.1; 430/120.1

(58) Field of Classification Search ..... 430/108.1, 430/120.1
See application file for complete search history.

(56) References Cited

U.S. PATENT DOCUMENTS

2008/0113290 A1 * 5/2008 Cheong et al. ..... 430/109.31

FOREIGN PATENT DOCUMENTS

JP A-5-2336 1/1993
JP A-2005-99122 4/2005

* cited by examiner

*Primary Examiner* — Hoa V Le
(74) *Attorney, Agent, or Firm* — Oliff & Berridge, PLC

(57) ABSTRACT

An electrostatic-image-developing toner includes: a binder resin; and a yellow pigment in an amount of from about 5 to about 50 ppm.

15 Claims, 5 Drawing Sheets

ELECTROSTATIC-IMAGE-DEVELOPING TONER AND PREPARATION PROCESS THEREOF, ELECTROSTATIC IMAGE DEVELOPER, TONER CARTRIDGE, PROCESS CARTRIDGE, IMAGE FORMING METHOD AND IMAGE FORMING APPARATUS

CROSS-REFERENCE TO RELATED APPLICATION

This application is based on and claims priority under 35 USC 119 from Japanese Patent Applications No. 2008-272712 filed Oct. 23, 2008.

BACKGROUND

1. Technical Field

The present invention relates to an electrostatic-image-developing toner and a preparation process thereof, an electrostatic image developer, a toner cartridge, a process cartridge, an image forming method and an image forming apparatus.

2. Related Art

There is a report on an electrophotographic invisible toner that is transferred and fixed on and around a color toner image desired to be imparted with gloss, such as photographic image by electrophotography, and imparts a good gloss image thereto.

SUMMARY

According to an aspect of the invention, there is provided an electrostatic-image-developing toner, including: a binder resin; and a yellow pigment in an amount of from about 5 to about 50 ppm.

BRIEF DESCRIPTION OF THE DRAWINGS

Exemplary embodiments of the present invention will be described in detail based on the following figures, wherein.

DETAILED DESCRIPTION (Electrostatic-Image-Developing Toner)

Figure 1:
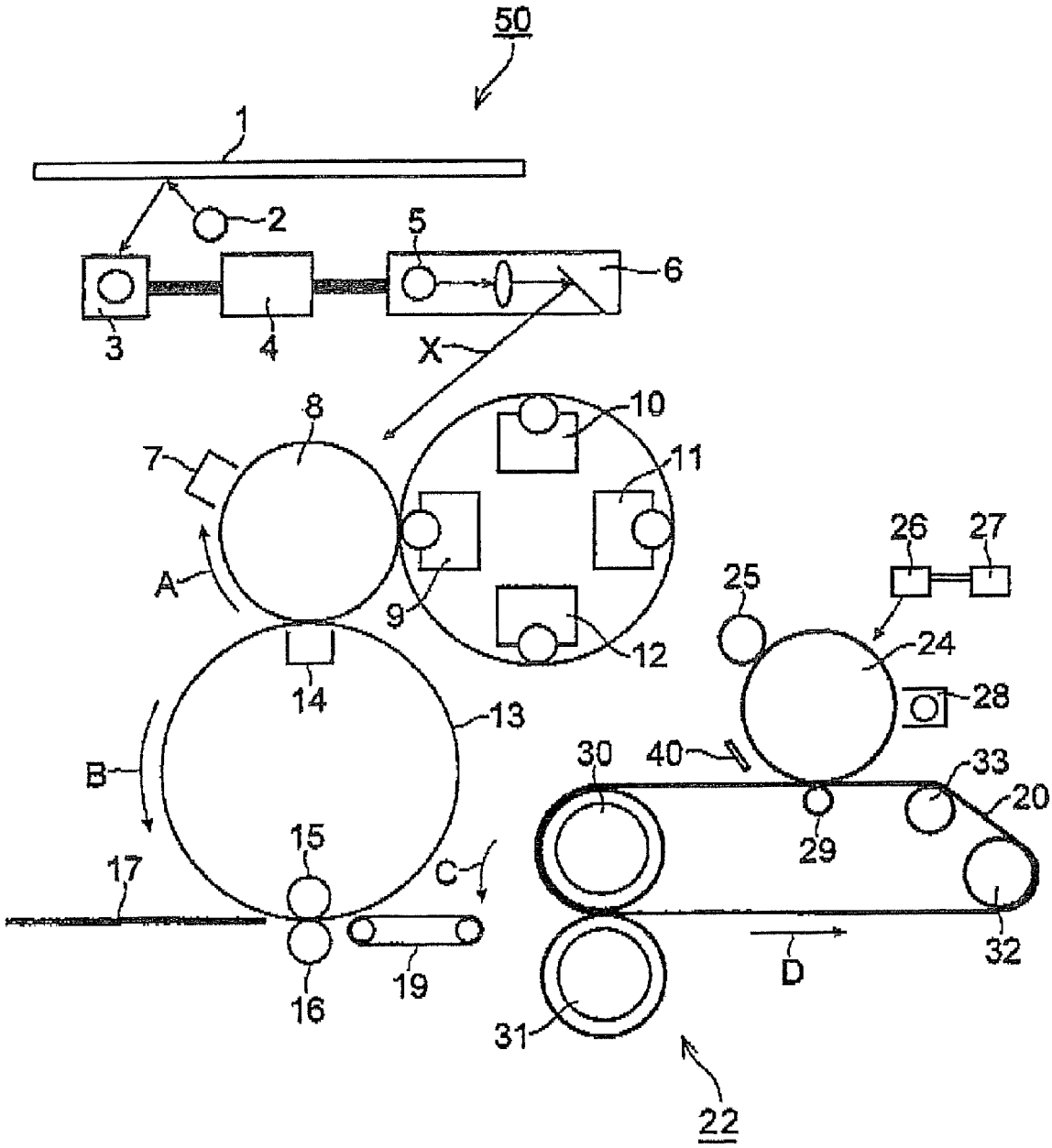
FIG. 1 is a schematic structural view illustrating one exemplary example of an image forming apparatus according to one exemplary embodiment.

The electrostatic-image-developing toner according to the present exemplary embodiment (which will hereinafter be called "toner" or "invisible toner", simply) contains at least a binder resin and a yellow pigment and it contains the yellow pigment in an amount of from 5 to 50 ppm or about 5 to about 50 ppm.

In the exemplary embodiment, the term "from A to B" indicating a range of a numerical value means "A or greater but B or less". In other words, the term "from A to B" includes both end points A and B.

The exemplary embodiment will hereinafter be described more specifically.

<Yellow Pigment>

The electrostatic-image-developing toner of the exemplary embodiment contains a yellow pigment in an amount of from 5 to 50 ppm or about 5 to about 50 ppm. When the content of a yellow pigment is less than 5 ppm, it cannot be detected by an optical sensor, making it difficult to control an image density. When the content of a yellow pigment exceeds 50 ppm, on the other hand, the electrostatic-image-developing toner is colored and becomes unsuited for use as an invisible toner.

The content of a yellow pigment is preferably from 10 to 45 ppm or about 10 to about 45 ppm, more preferably from 15 to 40 ppm or about 15 to about 40 ppm, still more preferably from 20 to 35 ppm or about 20 to about 35 ppm.

The term "content of a yellow pigment" means "the content of an entire toner" even if it is a toner obtained by adding an external additive to mother toner particles.

Yellow pigments may be used either singly or in combination. When two or more yellow pigments are used, the above content means a total amount of the yellow pigments.

In the electrostatic-image-developing toner of the exemplary embodiment, a content of colorants other than yellow pigment(s) is preferably 10 ppm or less, more preferably 5 ppm or less. The toner is still more preferably free of the other colorants.

The electrostatic-image-developing toner of the exemplary embodiment is suited as an electrostatic-image-developing toner capable of providing a high gloss image by being transferred and fixed onto or around a color toner image requiring gloss such as photographic image formed by electrophotography. The content of the other colorants within the above range is therefore preferred because coloration of the electrostatic-image-developing toner can be prevented.

No particular limitation is imposed on the yellow pigment insofar as it is a pigment having an absorption peak wavelength at a wavelength of from 530 nm to 620 nm and it can be selected as needed from known yellow pigments.

Examples of the yellow pigment include monoazo pigments such as C.I. Pigment Yellow 74 represented by the following formula (3), and C.I. Pigment Yellow 1, 2, 3, 5, 6, 49, 65, 73, 75, 97, 98, 111, 116 and 130; benzimidazolone pigments such as C.I. Pigment Yellow 154 represented by the following formula (4) and C.I. Pigment Yellow 120, 151, 175, 180, 181 and 194; disazo pigments such as C.I. Pigment Yellow 93 represented by the following formula (5) and C.I. Pigment Yellow 94, 95, 128, 166, 12, 13, 14, 17, 55, 63, 81, 83, 87, 90, 106, 113, 114, 121, 124, 126, 127, 136, 152, 170, 171, 172, 174, 176, and 188; isoindolinone pigments such as C.I. Pigment Yellow 110 represented by the following formula (6), and C.I. Pigment yellow 109; anthraquinone pigments such as C.I. Pigment Yellow 147 represented by the following formula (7) and C.I. Pigment Yellow 24, 108, 193 and 199; azolake pigments such as C.I. Pigment Yellow 61, 62, 133, 168 and 169; isoindolinone pigments such as C.I. Pigment Yellow 139; and quinophthalone pigments such as C.I. Pigment Yellow 138.

(3)

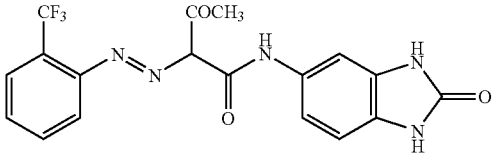

(4)

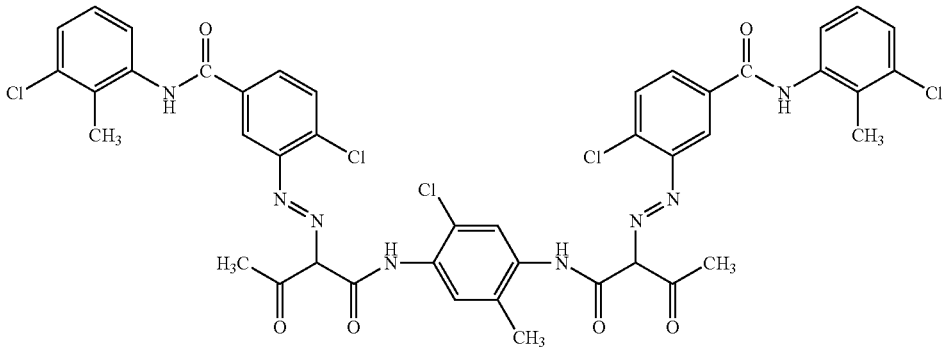

(5)

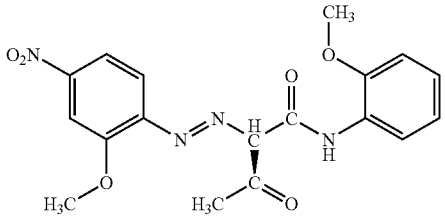

(6)

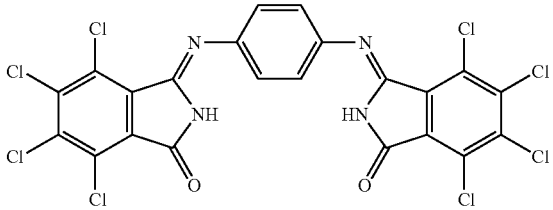

(7)

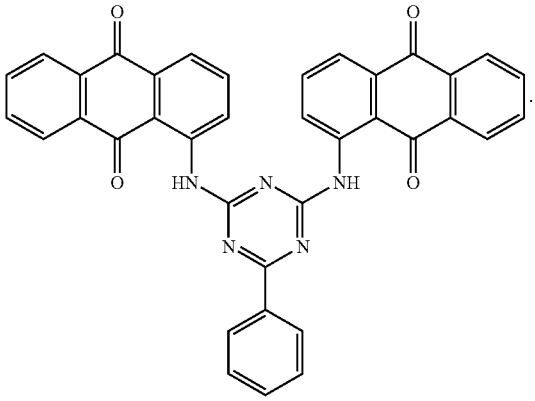

Of these, the yellow pigment is selected preferably from the group consisting of monoazo pigments, disazo pigments and benzimidazolone pigments, more preferably from the group consisting of monoazo pigments, disazo pigments and benzimidazolone disazo pigments.

In particular, the monoazo pigment is preferably C.I. Pigment Yellow 74, the disazo pigment is preferably C.I. Pigment Yellow 93; and the benzimidazolone disazo pigment is preferably C.I. Pigment Yellow 180.

<Dispersing Method of Yellow Pigment>

In the exemplary embodiment, the yellow pigment of the toner may be dispersed in a binder resin in a known manner. When the toner is obtained by kneading and grinding process, the yellow pigment may be used as is. It is also possible to employ a so-called masterbatch process in which after obtaining a high concentration dispersion of the yellow pigment in a resin in advance, the resulting dispersion is kneaded with a binder resin at the time of kneading or a flushing process in which after synthesis of the yellow pigment, it is dispersed in a resin in the form of a wet cake before drying.

The above yellow pigment may be used as is for toner preparation by using suspension polymerization process. In the suspension polymerization process, the yellow pigment dispersed in a resin is dissolved or dispersed in a polymerizable monomer to disperse the yellow pigment in granulated particles.

When the toner is prepared using an aggregation coalescence process, mother toner particles can be obtained by dispersing the yellow pigment and a dispersant such as surfactant in an aqueous medium through mechanical impact or the like to form a dispersion of the yellow pigment, aggregating the resulting dispersion with binder resin particles, and granulating the aggregated particles into a toner particle size.

Specific examples of the method of dispersing the yellow pigment through mechanical impact or the like include a media dispersing machine such as a rotation shearing homogenizer, a ball mill, a sand mill and an attritor, and a high pressure counter collision dispersing machine, by which a dispersion of the yellow pigment can be prepared. The yellow pigment can also be dispersed in an aqueous medium with a homogenizer by using a surfactant having polarity.

<Binder Resin>

The electrostatic-image-developing toner according to the exemplary embodiment contains a binder resin.

No particular limitation is imposed on the binder resin and examples of it include ethylene resins such as polyethylene and polypropylene, styrene resins composed mainly of polystyrene or poly(α-methylstyrene), (meth)acrylic resins composed mainly of polymethyl methacrylate or polyacrylonitrile, polyamide resins, polycarbonate resins, polyether resins, and polyester resins, and copolymer resins thereof. They may be used either singly or in combination.

In the exemplary embodiment, the binder resin contains, among the above resins, preferably a polyester resin and it has more preferably a polyester resin content of from 70 to 100 wt. % or about 70 to about 100 wt. % based on the total amount of the binder resin. The binder resin having the polyester resin content falling within the above range is preferred because it is excellent in low-temperature fixing property. The content of the polyester resin is more preferably from 80 to 100 wt. % or about 80 to 100 wt. %, still more preferably from 90 to 100 wt. % or about 90 to 100 wt. % based on the total amount of the binder resin.

The term "crystalline" of the crystalline polyester resin to be used for the electrostatic-image-developing toner of the exemplary embodiment denotes that the resin has a clear endothermic peak and does not have a stepwise endothermic amount change in differential scanning calorimetry (DSC). More specifically, it means that the half width value of the endothermic peak as measured at a heating rate of 10° C./min is within 15° C. Resins having a half-width value exceeding 15° C. or showing no clear endothermic peak mean non-crystalline resins (amorphous polymers). As a non-crystalline resin to be used in the exemplary embodiment, use of a resin showing no clear endothermic peak is preferred.

The "crystalline polyester resin" to be used for the toner of the exemplary embodiment means not only a polymer having, as the constituent thereof, only a polyester structure but also a polymer (copolymer) obtained by polymerization of a component constituting polyester and another component. In the latter case, however, the amount of the component other than the polyester constituting the polymer (copolymer) is less than 50 wt. %.

The electrostatic-image-developing toner of the exemplary embodiment preferably contains at least a crystalline polyester resin as the binder resin. The binder resin preferably contains, in addition to the crystalline polyester resin, a polycondensation resin such as non-crystalline polyester resin. The polyester resin is available by polycondensation of at least one compound selected from the group consisting of polycondensable monomers, and oligomers and prepolymers thereof. The polyester resin including the crystalline polyester resin to be used in the exemplary embodiment will hereinafter be described.

[Polyester Resin]

Examples of the polycondensable monomer to be used for the polycondensation for the synthesis of a polyester resin include polycarboxylic acids and polyols. The polyester resin is preferably that obtained using a polycarboxylic acid and a polyol as the polycondensable monomers, more preferably a dicarboxylic acid as the polycarboxylic acid and a diol as the polyol.

In the exemplary embodiment, the polycarboxylic acids include aliphatic, alicyclic, and aromatic carboxylic acids and hydroxycarboxylic acids, and alkyl esters thereof, while the polyols include polyhydric alcohols, ester compounds thereof, and hydroxycarboxylic acids. The polyester resin can be prepared by polycondensation using a direct esterification reaction or ester exchange reaction of the polycondensable monomers. In this case, the polyester resin obtained by polymerization is provided in any form of amorphous (amorphous/noncrystalline) polyester or crystalline polyester, or a mixture thereof.

The polycarboxylic acid used as the polycondensable monomer is a compound having, in one molecule thereof, two or more carboxyl groups.

Of these, dicarboxylic acids are compounds having, in one molecule thereof, two carboxyl groups. Examples include oxalic acid, succinic acid, maleic acid, itaconic acid, adipic acid, glutaric acid, β-methyladipic acid, azelaic acid, sebacic acid, suberic acid, nonanedicarboxylic acid, decanedicarboxylic acid, undecanedicarboxylic acid, dodecanedicarboxylic acid, tetradecanedicarboxylic acid, octadecanedicarboxylio acid, fumaric acid, citraconic acid, diglycolic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid, cyclohexanedicarboxylic acid, cyclohexenedicarboxylic acid, cyclohexane-3,5-diene-1,2-dicarboxylic acid, malic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, norbornene-2,3-dicarboxylic acid, adamantanedicarboxylic acid, and adamantanediacetic acid.

Examples of the trivalent or higher valent carboxylic acids include trimellitic acid, pyromellitic acid, naphthalenetricarboxylic acid, naphthalenetetracarboxylic acid, pyrenetricarboxylic acid, pyrenetetracarboxylic acid, and mesaconic acid, and lower esters thereof. Chlorides of the above polycarboxylic acids can also be exemplified. The exemplary embodiment is however not limited to them.

They may be used either singly or in combination. The polycarboxylic acids may also include, as well as the above aliphatic dicarboxylic acids and aromatic dicarboxylic acids, dicarboxylic acid components having a double bond.

The polyol to be used in the exemplary embodiment is a compound having, in one molecule thereof, two or more hydroxyl groups. Examples of the diol having, in one molecule thereof, two hydroxyl groups include ethylene glycol, propylene glycol, butanediol, butenediol, neopentyl glycol, pentanediol, hexanediol, heptanediol, cyclohexanediol, cylcohexanedimethanol, diethylene glycol, triethylene glycol, dipropylene glycol, octanediol, nonanediol, decanediol, undecanediol, dodecanediol, tridecanediol, tetradecanediol, octadecanediol, eicosanedecanediol, diethylene glycol, triethylene glycol, polyethylene glycol, dipropylene glycol, polypropylene glycol, polytetramethylene glycol, bisphenol A, bisphenol Z, and hydrogenated bisphenol A.

Examples of the polyol having, in one molecule thereof, three or more hydroxyl groups include glycerin, pentaerythritol, hexamethylolmelamine, hexaethylolmelamine, tetramethylolbenzoguanamine, and tetraethylolbenzoguanamine.

These polyols may be used either singly or in combination.

[Crystalline Polyester Resin]

In the present embodiment, the binder resin preferably contains a polyester resin, more preferably a crystalline polyester resin, still more preferably a crystalline polyester resin in an amount of from 5 to 30 wt. % or about 5 to about 30 wt. % based on the total amount of the binder resin.

Contents of the crystalline polyester resin within the above range are preferred because they do not cause secondary defects (such as thermal blocking and charging failures), facilitate dissolution and enable low-temperature fixing.

The content of the crystalline polyester resin in the entire binder resin is preferably from 10 to 25 wt. % or about 10 to about 25 wt. %, more preferably from 15 to 20 wt. % or about 15 to about 20 wt. %.

Examples of the polycarboxylic acid to be used for obtaining the crystalline polyester resin include, of the above carboxylic acids, aliphatic dicarboxylic acids such as oxalic acid, malonic acid, succinic acid, glutaric acid, adipic acid, pimeric acid, suberic acid, azelaic acid, sebacic acid, 1,9-nonanedicarboxylic acid, 1,10-decamethylenedicarboxylic acid, 1,12-dodecanedicarboxylic acid, 1,14-tetradecanedicarboxylic acid, and 1,18-octadecanedicarboxylic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, and n-octenylsuccinic acid, and acid anhydrides, lower esters or acid chlorides thereof.

Examples of the diol to be used for obtaining the crystalline polyester resin include ethylene glycol, diethylene glycol, triethylene glycol, polyethylene glycol, 1,2-propylene glycol, 1,3-propylene glycol, dipropylene glycol, polypropylene glycol, 1,4-butanediol, 1,4-butenediol, neopentyl glycol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol, polytetramethylene ether glycol, 1,4-cyclohexanediol, 1,4-cyclohexanedimethanol, and polytetramethylene glycol.

Dihydric or higher hydric can also be used in combination. Examples of such an alcohol include glycol, pentaerythritol, hexamethylolmelamine, hexaethylolmelamine, tetramethylolbenzoguanamine, and tetraethylolbenzoguanamine.

Preferred examples of the crystalline polyester resin include that available by the reaction between 1,9-nonanediol and 1,10-decanedicarboxylic acid, that available by the reaction between 1,9-nonanediol and azelaic acid; that available by the reaction between cyclohexanediol and adipic acid, that available by the reaction between 1,9-nonanediol and sebacic acid, that available by the reaction between 1,6-hexanediol and sebacic acid, that available by the reaction between ethylene glycol and succinic acid, that available by the reaction between ethylene glycol and sebacic acid, and that available by the reaction between 1,4-butanediol and succinic acid. Of these, that available by the reaction between 1,9-nonanediol and 1,10-decanedicarboxylic acid, that available by the reaction between 1,9-nonanediol and azelaic acid; that available by the reaction between 1,9-nonanediol and sebacic acid, and that available by the reaction between 1,6-hexanediol and sebacic acid are especially preferred.

[Non-Crystalline Polyester Resin]

In the exemplary embodiment, the binder resin preferably contains a non-crystalline polyester resin. Use of the crystalline polyester resin and non-crystalline polyester resin in combination is more preferred.

The content of the non-crystalline polyester resin is preferably from 70 to 95 wt. %, more preferably from 75 to 90 wt. %, still more preferably from 80 to 85 wt. % based on the total amount of the binder resin.

Contents of the non-crystalline polyester resin within the above range are preferred because they provide an excellent fixing property.

Examples of a divalent carboxylic acid to be used for obtaining the non-crystalline polyester resin include phthalic acid, isophthalic acid, terephthalic acid, tetrachlorophthalic acid, chlorophthalic acid, nitrophthalic acid, malonic acid, mesaconic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, cyclohexanedicarboxylic acid, cyclohexenedicarboxylic acid, norbornene-2,3-dicarboxylic acid, adamantanedicarboxylic acid and adamantanediacetic acid.

Examples of the trivalent or higher valent carboxylic acids include trimellitic acid, pyromellitic acid, naphthalenetricarboxylic acid, naphthalenetetracarboxylic acid, pyrenetricarboxylic acid, and pyrenetetracarboxylic acid.

A compound obtained by inducing the carboxyl group of the above polycarboxylic acid to the corresponding acid anhydride, acid chloride or lower ester may also be used. The term "lower ester" as used herein means an ester of an aliphatic alcohol having from 1 to 8 carbon atoms.

Of these polycarboxylic acids, terephthalic acid or lower esters thereof, phenylenediacetic acid, phenylenedipropanoic acid, and cyclohexanedicarboxylic acid are preferred, with 1,4-phenylenediacetic acid, 1,4-phenylendipropanoic acid, and 1,4-cyclohexanedicarboxylic acid being more preferred.

Preferred examples of the polyol used for obtaining the noncrystalline polyester resin include, of the above polyols, polytetramethylene glycol, bisphenol A, bisphenol Z, bisphenol S, bisphenol, naphthalenediol, adamantanediol, adamantanedimethanol, hydrogenated bisphenol A and cyclohexanedimethanol.

The above bisphenols are preferably alkylene oxide adducts. Examples of the alkylene oxide group include ethylene oxide group, propylene oxide group, and butylene oxide group. Of these, ethylene oxide and propylene oxide are preferred.

These non-crystalline polyester resins are preferably non-crystalline polyester resins having a bisphenol structure, more preferably non-crystalline polyester resins available by polycondensation of a polyol having a bisphenol structure and/or a polycarboxylic acid having a bisphenol structure, still more preferably polyesters prepared using a polyol having a bisphenol structure.

The bisphenol structure is not particularly limited insofar as it is a structure composed of two phenol groups. Examples include, but not limited to, bisphenol A, bisphenol C, bisphenol E, bisphenol F, bisphenol M, bisphenol P, bisphenol S, and bisphenol Z. Of these, bisphenol A, bisphenol C, bisphenol E, bisphenol F, bisphenol M, bisphenol P, bisphenol S, and bisphenol Z are preferred, with bisphenol A, bisphenol E, and bisphenol F being more preferred.

As the polycondensable monomer to be used for obtaining the non-crystalline polyester resin having a bisphenol structure, polyols having a bisphenol structure are preferred, with bisphenol and alkylene oxide adducts of bisphenol being more preferred.

Examples of the alkylene oxide include $C_{1-6}$ alkylene oxides such as ethylene oxide, propylene oxide, and butylene oxide. Of these, ethylene oxide and propylene oxide are more preferred.

As the above polyols to be used for obtaining the non-crystalline polyester resin, alkylene oxide adducts of bisphenol A are preferred, with ethylene oxide adduct of bisphenol A and propylene oxide adduct of bisphenol A being more preferred. The molar number of the alkylene oxide is preferably from 2 to 4 moles in terms of that at both terminals (total molar number), more preferably 2 mols or 4 mols. When the molar number is within the range, the resulting polyester can have a properly controlled viscoelasticity or glass transition temperature suited for use in a toner.

The non-crystalline polyester resin contains the non-crystalline polyester resin having a bisphenol structure in an amount of preferably from 30 to 100 wt.%, more preferably from 50 to 100 wt. %, still more preferably form 70 to 100 wt. %, based on the total amount of the non-crystalline polyester resin.

The non-crystalline polyester resin having a bisphenol structure contains a monomer unit having a bisphenol structure in an amount of preferably 30 mo % or greater, more preferably 40 mol % or greater in all the monomer units including the polyol-derived monomer unit and the polycarboxylic-acid-derived monomer unit.

The non-crystalline polyester resin is preferably a polyester resin obtained by reacting an ethylene oxide adduct and/or propylene oxide adduct of bisphenol A with terephthalic acid. In addition to them, use of at least one polycarboxylic acid selected from the group consisting of fumaric acid, dodecenylsuccinic acid, and trimellitic anhydride as a polycarboxylic acid component is also preferred.

In order to produce one polyester resin (crystalline polyester resin or non-crystalline polyester resin), one of the polycarboxylic acids and one of the polyols may be used; one of the polycarboxylic acids and two or more of the polyols may be used, or vise versa; or two or more of the polycarboxylic acids and two or more of the polyols may be used. When hydroxycarboxylic acids are used for preparing one polycondensation resin, they may be used either singly or in combination, or may be used in combination with the polycarboxylic acid or polyol.

In the exemplary embodiment, the crystal melting temperature Tm of the crystalline polyester resin is preferably from 50 to 100° C., more preferably from 50 to 90° C., still more preferably from 50 to 80° C. The crystal melting temperatures falling within the above range are preferred because they improve the releasing property and low-temperature fixing property and moreover, reduce the offset.

The melting temperature of the crystalline polyester resin is measured with a differential scanning calorimeter. It can be found as a melting peak temperature in the input compensation differential scanning calorimetry specified in JIS K7121: 87 when measurement is performed at a heating rate of 10° C. per minute from room temperature (20° C.) to 180° C. Although the crystalline polyester resin sometimes exhibits a plurality of melting peaks, the maximum peak is taken as the melting temperature in the exemplary embodiment.

The glass transition temperature (Tg) of the non-crystalline polyester resin is preferably 30° C. or greater, more preferably from 30 to 100° C., still more preferably from 50 to 80° C.

When the glass transition temperature falls within the above range, a stable image forming performance can be provided for a long period of time, because since the non-crystalline polyester resin is used in glass form, toner particles do not aggregate even by exposure to heat or pressure upon image formation and therefore do not attach and deposit in the apparatus.

The glass transition temperature of the non-crystalline polyester resin is a value measured using a method (DSC method) specified in ASTM D3418-82.

In the exemplary embodiment, the glass transition temperature is measured in accordance with, for example, differential scanning calorimetry by using, for example, "DSC-20" (trade name; product of Seiko Instruments). More specifically, the glass transition temperature can be determined from an intersection between a base line and a slope line of an endothermic peak obtained by heating about 10 mg of a sample at a certain heating rate (10° C./min).

The weight average molecular weight of the crystalline polyester resin is preferably from 10,000 to 60,000, more preferably from 15,000 to 45,000, still more preferably from 20,000 to 30,000.

The weight average molecular weight of the non-crystalline polyester resin is preferably from 5,000 to 100,000, more preferably from 10,000 to 90,000, still more preferably from 20,000 to 80,000.

Weight average molecular weights within the above ranges are preferred because they can achieve both a desired image intensity and fixing property. The above weight average molecular weights can each be obtained by molecular weight measurement using gel permeation chromatography (GPC) of a tetrahydrofuran (THF) soluble content. The molecular weight of the resin is determined by analyzing a component soluble in THF used as a solvent by using TSK-GEL ("GMH", trade name; product of TOSOH) and calculating from a molecular weight calibration curve drawn using a monodisperse polystyrene standard sample.

The acid value of each of the crystalline polyester resin and the non-crystalline polyester resin is preferably from 1 to 50 mgKOH/g, more preferably from 5 to 50 mgKOH/g, still more preferably from 8 to 50 mgKOH/g.

Acid value within the above range are preferred because they can achieve excellent fixing property and charge stability.

In the exemplary embodiment, the polycondensation step may include a polymerization reaction between the polycarboxylic acid and the polyol, which are polycondensation monomers as described above, and an oligomer and/or prepolymer prepared in advance. The prepolymer is not limited insofar as it is a polymer which can be fused or uniformly mixed with the monomers.

In the exemplary embodiment, the binder resin may have a homopolymer of the above polycondensation component, a copolymer obtained using, in combination, two or more monomers including the above polycondensation component, or a mixture, graft polymer, or partially branched or crosslinked structure thereof, insofar as it contains the crystalline polyester resin.

The crystalline polyester resin and the non-crystalline polyester resin can each be prepared by the condensation reaction between the polyhydric alcohol and the polycarboxylic acid in a conventional manner. For example, it can be prepared by charging the above polyhydric alcohol and the polyvalent carboxylic acid, and if necessary a catalyst, blending them in a reaction vessel fitted with a thermometer, a stirrer and a reflux condenser, heating the resulting mixture to from 150 to 250° C. in an inert gas (such as nitrogen gas), continuously removing low molecular by-products from the reaction system, terminating the reaction when the reaction product reaches a predetermined acid value, and cooling it to obtain a target reaction product.

Examples of catalysts to be used in the synthesis of these polyester resins include esterification catalysts, e.g., organic metals such as dibutyltin dilaurate and dibutyltin oxide, and metal alkoxides such as tetrabutyl titanate. Such a catalyst is added in an amount of preferably from 0.01 to 1 wt. % based on the total amount of the raw materials.

[Another Binder Resin]

In the exemplary embodiment, conventionally known thermoplastic binder resins may be used, as the binder resin, either singly or in combination with the above crystalline polyester resin or non-crystalline polyester resin. Specific examples include homopolymers or copolymers of a styrene (styrene resins) such as styrene, para-chlorostyrene and α-methylstyrene; homopolymers or copolymers of a vinyl-containing ester ((meth)acrylate resins) such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; homopolymers or copolymers of a vinyl nitrile (vinyl nitrile resins) such as acrylonitrile and methacrylonitrile; homopolymers or copolymers of a vinyl ether (vinyl ether resins) such as vinyl methyl ether and vinyl isobutyl ether; homopolymers or copolymers of a vinyl ketone (vinyl ketone resins) such as vinyl methyl ketone, vinyl ethyl ketone and vinyl isopropenyl ketone; homopolymers or copolymers of an olefin (olefin resins) such as ethylene, propylene, butadiene, and isoprene; non-vinyl condensed resins such as epoxy resin, polyurethane resin, polyamide resin, cellulose resin, and polyether resin; and graft polymers obtained from the above non-vinyl condensed resin and a vinyl monomer. These resins may be used either singly or in combination. Of these resins, the above various vinyl resins are preferred.

The vinyl resin is advantageous because a resin particle dispersion can be prepared easily by emulsion polymerization or seed polymerization using an ionic surfactant. As the vinyl monomer, monomers serving as raw materials for a vinyl high molecular acid or a vinyl high molecular base such as acrylic acid, methacrylic acid, maleic acid, cinnamic acid, fumaric acid, vinylsulfonic acid, ethyleneimine, vinylpyridine, and vinylamine are usable.

Styrene resins and (meth)acrylic resins, especially styrene-(meth)acrylic copolymer resins may be used as the non-crystalline resin in the exemplary embodiment.

A dispersion obtained by the dispersion stabilization, with a surfactant, of a copolymer available by polymerizing a monomer mixture composed of from 50 to 90 parts by weight of a vinyl aromatic monomer (styrene monomer), from 10 to 50 parts by weight of an ethylenically unsaturated carboxylate monomer ((meth)acrylate monomer), from 0 to 10 parts by weight of another monomer copolymerizable with these monomers, and from 1 to 3 parts by weight of an ethylenically unsaturated acid monomer is preferred as a non-crystalline resin component. The above copolymer has a glass transition temperature of preferably from 50 to 70° C.

The polymerizable monomer constituting the above copolymer resin will next be described.

Examples of the styrene monomer include styrene, α-methylstyrene, vinylnaphthalene, alkyl-substituted styrenes having an alkyl chain such as 2-methylstyrene, 3-methylstyrene, 4-methylstyrene, 2-ethylstyrene, 3-ethylstyrene, and 4-ethylstyrene, halogen-substituted styrenes such as 2-chlorostyrene, 3-chlorostyrene and 4-chlorostyrene, and fluorine-substituted styrenes such as 4-fluorostyrene and 2,5-difluorostyrene. Styrene is preferred as the styrene monomer.

Examples of (meth)acrylate monomer include n-methyl (meth)acrylate, n-ethyl (meth)acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth) acrylate, isobutyl (meth)acrylate, t-butyl (meth)acrylate, isopentyl (meth)acrylate, amyl (meth)acrylate, neopentyl (meth)acrylate, isohexyl (meth)acrylate, isoheptyl (meth) acrylate, isooctyl (meth)acrylate, 2-ethyhexyl (meth)acrylate, phenyl (meth)acrylate, biphenyl (meth)acrylate, diphenylethyl (meth)acrylate, t-butylphenyl (meth)acrylate, terphenyl (meth)acrylate, cyclohexyl (meth)acrylate, t-butylcyclohexyl (meth)acrylate, dimethylaminoethyl (meth)acrylate, diethylaminoethyl (meth)acrylate, methoxyethyl (meth) acrylate, 2-hydroxyethyl (meth)acrylate, β-carboxyethyl (meth)acrylate, (meth)acrylonitrile, and (meth)acrylamide. As the (meth)acrylate monomer, n-butyl acrylate is preferred.

The ethylenically unsaturated acid monomer contains an acid group such as carboxyl group, sulfonic acid group, or acid anhydride.

In order to incorporate a carboxyl group in the styrene resin, (meth)acrylic resin, or styrene-(meth)acrylic copolymer resin, it can be achieved by the copolymerization of a polymerizable monomer having a carboxyl group.

Specific examples of the carboxyl-containing polymerizable monomer include acrylic acid, aconitic acid, atropic acid, allylmalonic acid, angelic acid, isocrotonic acid, itaconic acid, 10-undecenoic acid, elaidic acid, erucic acid, oleic acid, ortho-carboxycinnamic acid, crotonic acid, chloroacrylic acid, chloroisocrotonic acid, chlorocrotonic acid, chlorofumaric acid, chloromaleic acid, cinnamic acid, cyclohexenedicarboxylic acid, citraconic acid, hydroxycinnamic acid, dihydroxycinnamic acid, tiglic acid, nitrocinnamic acid, vinylacetic acid, phenylcinnamic acid, 4-phenyl-3-butenoic acid, ferulic acid, fumaric acid, brassidic acid, 2-(2-furyl) acrylic acid, bromocinnamic acid, bromofumaric acid, bromomaleic acid, benzylidenemalonic acid, benzoylacrylic acid, 4-pentenoic acid, maleic acid, mesaconic acid, methacrylic acid, methylcinnamic acid, and methoxycinnamic acid. From the viewpoint of facilitating the polymer formation reaction, acrylic acid, methacrylic acid, maleic acid, cinnamic acid, and fumaric acid are preferred, with acrylic acid being more preferred.

When the binder resin to be used for the toner of the exemplary embodiment is prepared, a chain transfer agent may be added at the time of polymerization. Although no particular limitation is imposed on the chain transfer agent, compounds having a thiol component, for example, can be employed. Described specifically, alkylmercaptans such as hexylmercaptan, heptylmercaptan, octylmercaptan, nonylmercaptan, decylmercaptan, and dodecylmercaptan are preferred. They are preferred because they have a very narrow molecular weight distribution and therefore can improve the high-temperature storage stability of the resulting toner.

The concentration of a dissociating group in the ethylenically unsaturated monomer is determined, for example, by the method as described in *Chemistry of Polymer Latex* (written by Soichi Muroi, published by Kobunshi Kanko Kai (1970)) in which particles such as toner particles are dissolved from the surface thereof, followed by analysis. By this method, the molecular weight or glass transition temperature of the resin from the surface to the inside of the particles can also be determined.

<Releasing Agent>

The toner of the exemplary embodiment contains preferably a releasing agent.

No limitation is imposed on the releasing agent and known ones are usable. Specific examples include olefin waxes such as low molecular weight polyethylene, low molecular weight polypropylene, copolymer polyethylene, grafted polyethylene, and grafted polypropylene; ester waxes having a long chain aliphatic group such as behenyl behenate, montanates, and stearyl stearate; plant waxes such as hydrogenated castor oil and carnauba wax; ketones having a long chain alkyl group such as distearyl ketone; silicon waxes having an alkyl group or phenyl group, higher fatty acids such as stearic acid and palmitic acid; higher fatty acid amides such as oleic amide and stearic amide; long chain fatty acid alcohols; long chain fatty acid polyhydric alcohols such as pentaerythritol and partial esters thereof; paraffin waxes; and Fischer-Tropsch waxes.

Of these, carnauba wax is preferred, because carnauba wax is colored yellow to green so that addition of it as a releasing agent improves the optical detection sensitivity of the toner further.

The melting temperature of the releasing agent is preferably from 50 to 110° C., more preferably from 60 to 100° C., still more preferably from 70 to 95° C. The melting temperatures of the releasing agent within the above range are preferred because they facilitate balancing between the releasing property and aggregation properties of the toner.

The amount of the releasing agent is preferably from 5 to 30 wt. %, more preferably from 5 to 25 wt. %, still more preferably from 10 to 15 wt. % based on the total weight of solids constituting the toner. The amounts of the releasing agent within the above range are preferred in order to maintain the releasing property of a fixed image.

When the toner is prepared using a chemical preparation process such as aggregation and coalescence process which will be described later, the dispersion of releasing agent particles has a median diameter of preferably 1 μm or less, more preferably from 0.1 to 0.8 μm. Median diameters of the releasing agent particles falling within the above range are preferred, because they facilitate control of aggregation properties during particle formation or control of the particle size distribution of the toner, making it possible to keep an appropriate releasing property at the time of fixing or to keep an appropriate offset generation temperature.

<Other Additives>

The toner of the exemplary embodiment contains, in addition to the above components, various components such as an internal additive, a charge controlling agent, inorganic powders (inorganic particles), and organic particles as needed.

Examples of the internal additive include magnetic materials such as metals, e.g., ferrite, magnetite, reduced iron, cobalt, nickel, and manganese, alloys thereof and compounds containing the metal.

In the exemplary embodiment, the toner may contain a charge controlling agent as needed.

As the charge controlling agent, known ones are usable. Azo metal complex compounds, metal complex compounds of salicylic acid, and polar-group-containing resin type charge controlling agents may be used. When the toner is prepared using the wet process, materials sparingly soluble in water are preferably employed from the standpoint of control of ionic strength (%) and reduction of waste water pollution. In the exemplary embodiment, the toner may be either a magnetic toner enclosing a magnetic material or a non-magnetic toner not containing a magnetic material.

[Internal Additive]

In the exemplary embodiment, an internal additive may be added to the toner. The internal additive is usually employed for the purpose of controlling a viscoelasticity of a fixed image.

Specific examples of the internal additive include inorganic particles such as silica and titania and organic particles such as polymethyl methacrylate. The internal additive may be surface-treated for enhancing dispersibility of it. These internal additives may be used either singly or in combination.

[External Additive]

In the exemplary embodiment, an external additive such as fluidizing agent or charge controlling agent may be added to the toner to treat it therewith.

As the external additive, known materials are usable and examples include inorganic particles such as silica particles, titanium oxide particles, alumina particles, cerium oxide particles and carbon black each surface-treated with a silane coupling agent, polymer particles such as polycarbonate, polymethyl methacrylate and silicon resin, amine metal salts, and metal complexes of salicylic acid. In the exemplary embodiment, these external additives may be used either singly or in combination.

<Properties of Toner>

In the exemplary embodiment, the cumulative volume average particle size $D_{50}$ of the toner is preferably from 3.0 to 9.0 μm, more preferably from 3.0 to 7.0 μm. When $D_{50}$ is 3.0 μm or greater, such a toner exhibits an adequate adhesive force and good developability. When $D_{50}$ is not greater than 9.0 μm, the toner provides excellent image resolution. The $D_{50}$ within the above range is therefore preferred.

In the exemplary embodiment, the volume average particle size distribution index GSDv of the toner is preferably 1.30 or less. The GSDv not greater than 1.30 is preferred because such a toner provides good resolution and does not easily cause image defects due to less occurrence of toner scattering or fogging.

In the exemplary embodiment, the cumulative volume average particle size $D_{50}$ and the average particle size distribution index of the toner can be determined, for example, in the following manner. Based on the particle size distribution measured by a measuring apparatus such as "Coulter Counter TAII" (trade name; product of Nikkaki) or "Multisizer II" (trade name; product of Nikkaki), cumulative distributions of the volume and the number are drawn from the small diameter side with respect to the divided particle size ranges (channels). The particle sizes at a cumulative amount of 16% are designated as $D_{16V}$ for volume and $D_{16P}$ for number, the particle sizes at a cumulative amount of 50% are designated as $D_{50V}$ for volume and $D_{50}$ for number, and the particle sizes at a cumulative amount of 84% are designated as $D_{84V}$ for volume and $D_{84P}$ for number. By using these values, the volume average particle size distribution index (GSDv) is calculated as $(D_{84V}/D_{16V})^{1/2}$, and the number average particle size distribution index (GSDp) is calculated as $(D_{84P}/D_{16P})^{1/2}$.

The shape factor SF1 of the toner is preferably from 110 to 140, more preferably from 120 to 140. It is known that spherical toner is easily transferred in the transfer step of an image formation method, while amorphous toner is easily cleaned in the cleaning step.

The SF1 is a shape factor showing the degree of irregularities on the surface of the toner particles and it is calculated in the following manner. An optical micrograph of toner particles scattered on a slide glass is imported into a Luzex image analyzer through a video camera. The SF1 is calculated based on the square of the maximum length/projected area $((ML)^2/$ A) of 50 toner particles in accordance with the following equation and an average is determined.

$$SF1 = \frac{(ML)^2}{A} \times \frac{\pi}{4} \times 100$$

wherein, ML represents the maximum length of a toner particles and A represents a projected area of the particles).

(Preparation Process of Toner)

In the exemplary embodiment, no particular limitation is imposed on the preparation process of toner. The toner is prepared using a mechanical process such as grinding or a so-called chemical process in which the toner is prepared from a resin particle dispersion obtained using the binder resin.

In the exemplary embodiment, no particular limitation is imposed insofar as it is a known process such as kneading and grinding process, aggregation coalescence process or suspension polymerization process. Of these, the aggregation coalescence process is preferred. A process including at least a step of aggregating binder resin particles and yellow pigment particles in a dispersion containing them to obtain aggregated particles (which may also be called "aggregation step") and a step of fusing the aggregated particles by beating (which may also be called "fusion step") is preferred.

In an invisible toner prepared using the kneading and grinding process or dissolution suspension process, localization of the yellow pigment is likely to occur and even after fixing, the localization cannot be eased. In the invisible toner prepared using the aggregation coalescence process, on the other hand, the yellow pigment is dispersed uniformly and even after fixing, the pigment is uniformly dispersible. The aggregation coalescence process is therefore preferred.

In the aggregation step, the binder resin is preferably used as a dispersion of binder resin particles.

A method of dispersing the binder resin in an aqueous medium and forming particles can also be selected from known methods such as forced emulsification, self emulsification and phase-inversion emulsification. Of these, self emulsification and phase-inversion emulsification methods are preferred in view of energy necessary for emulsification, controllability of the particle size of the emulsion thus obtained, stability and the like.

The description on the self emulsification and phase-inversion emulsification can be found in *Application Technology of Ultrafine Particle Polymer* (CMC Publishing). A polar group to be used for self emulsification is, for example, a carboxyl group or sulfone group.

As the binder resin particle dispersion, a dispersion of the binder resin obtained by emulsion polymerization through miniemulsion method or the like may also be employed.

For the preparation of another dispersion of the binder resin, an organic solvent may be employed. When the organic solvent is used, it is preferred to remove a portion of the organic solvent and thereby form resin particles.

For example, it is preferred to emulsify a material containing the binder resin, and then remove a portion of the organic solvent to solidify the remaining portion as particles. Specific solidification methods include a method of emulsifying and dispersing a material containing a polycondensed resin in an aqueous medium and then drying off the organic solvent at a vapor-liquid interface while stirring the dispersion and feeding air or an inert gas such as nitrogen thereto (air blowing drying method), a method of drying the dispersion while maintaining it under reduced pressure and, if necessary, bubbling an inert gas as needed (a pressure reduction topping method), and a method of discharging, like shower, an emulsified dispersion obtained by emulsifying and dispersing a material containing a polycondensation resin in an aqueous medium or an emulsion of a material containing a polycondensation resin, from apertures to a saucer and repeating this procedure to dry off the organic solvent (a shower system desolvating method). It is preferred to remove the solvent by using the method selected properly from them or a combination of the methods, depending on the evaporation speed and water solubility of the organic solvent to be used.

The volume average particle size of the resin particle dispersion is preferably 0.05 μm or greater but not greater than 2.0 μm, more preferably 0.1 μm or greater but not greater than 1.5 μm, still more preferably 0.1 μm or greater but not greater than 1.0 μm. The volume average particle sizes within the above range are preferred because the resin particles are dispersed stably in the aqueous medium. In addition, when such a resin particle dispersion is used for toner preparation, the particle size can be controlled easily and in addition, a releasing property and offset resistance at the time of fixing are excellent, so that they are preferred.

The volume average particle size of resin particles is measured, for example, with a laser diffraction particle size distribution analyzer ("LA-920", trade name; product of Horiba, Ltd.).

Although no particular limitation is imposed on the aggregation process employed in the aggregation step, aggregation processes conventionally employed in the aggregation and coalescence process of toner, for example, a process of reducing the stability of an emulsion by temperature elevation, pH change, salt addition or the like and stirring it with a disperser or the like are usable.

In the above aggregation step, particles in a mixture of the resin particle dispersion and the yellow pigment dispersion and, if necessary, the releasing agent dispersion aggregates with each other to form aggregated particles having a toner particle size. These aggregated particles are formed by heteroaggregation or the like. An ionic surfactant having a polarity different from that of the aggregated particles or a monovalent or polyvalent compound such as metal salt is added for the purpose of stabilizing the aggregated particles or regulating their particle size or particle size distribution.

In the aggregation step, the particle size and particle size distribution of the toner can be regulated, for example, by polymerizing, in the presence of a polymerization initiator, monomers in an oil droplet emulsified and dispersed in a water phase to obtain resin polymer particles and aggregating (associating) the resulting polymer particles and particles containing at least yellow pigment particles (when the yellow pigment is added to the resin in advance in the polymerization step, the polymer particles are yellow-pigment containing articles themselves) through a known aggregation process. Described specifically, toner particles having controlled particle size or particle size distribution are available by mixing the resin particle dispersion with the yellow pigment particle dispersion, releasing agent particle dispersion, and the like, adding an aggregating agent to the resulting mixture to cause heteroaggregation and form aggregated particles of a toner size, fusing and coalescing the resulting aggregated particles by heating them to the glass transition temperature or melting temperature of the resin particles or greater, and then, washing and drying. The toner shape can be controlled from amorphous to spherical by selecting the heating temperature condition.

In the aggregation step, it is also possible to mix two or more resin particle dispersions and then carry out steps on and after aggregation. In this case, it is possible to form multilayer particles, for example, by aggregating one of resin particle dispersions in advance to form first aggregated particles and adding another resin particle dispersion to form a second shell layer on the surface of the first aggregated particles. Multilayer particles may of course be formed in the reverse order.

<Aggregating Agent>

When the aggregation coalescence process is employed for toner preparation, toner particles can be prepared by inducing aggregation in the aggregation step by a pH change. At the same time, an aggregating agent may be added in order to stably and promptly induce aggregation or to obtain aggregated particles having a narrower particle size distribution.

As the aggregating agent, compounds having a monovalent or higher valent one are preferred, and specific examples thereof include water soluble surfactants such as ionic surfactants and nonionic surfactants, acids such as hydrochloric acid, sulfuric acid, nitric acid, acetic acid and oxalic acid, metal salts of an inorganic acid such as magnesium chloride, sodium chloride, aluminum chloride (including polyaluminum chloride), aluminum sulfate, calcium sulfate, ammonium sulfate, aluminum nitrate, silver nitrate, copper sulfate, and sodium carbonate, metal salts of an aliphatic acid or aromatic acid such as sodium acetate, potassium formate, sodium oxalate, sodium phthalate, and potassium salicylate, metal salts of a phenol such as sodium phenolate, metal salts of an amino acid, and inorganic acid salts of an aliphatic or aromatic amine such as triethanolamine hydrochloride and aniline hydrochloride.

When stability of aggregated particles, stability of the aggregating agent against heat or passage of time or removal of it at the time of washing are considered, metal salts of an inorganic acid are preferred as the aggregating agent from the viewpoint of performance and ease of use. Specific examples include metal salts of an inorganic acid such as magnesium chloride, sodium chloride, aluminum chloride (including polyaluminum chloride), aluminum sulfate, ammonium sulfate, aluminum nitrate, silver nitrate, copper sulfate, and sodium carbonate.

The amount of the aggregating agent may be small, though depending on the valency and is about 3 wt. % or less for a monovalent compound, about 1 wt. % or less for a divalent compound, and about 0.5 wt. % or less for a trivalent compound, each based on the total amount of the toner. The amount of the aggregating agent is preferably as smaller so that use of a compound having higher valency is preferred.

After the aggregation treatment, the surfaces of the particles may be crosslinked by heat treatment in order to suppress leaching of the colorant from the surfaces of the particles. The surfactant and the like employed for aggregation may be removed as needed by washing with water, an acid or an alkali.

In the fusion step, the binder resin in the aggregated particles is fused at least the melting temperature or glass transition temperature of the binder resin and the shape of the aggregated particles changes from amorphous to spherical.

The phase separated structure of the core-shell particles in the toner is maintained preferably by fusing under temperature condition within +50° C. of the glass transition temperature of the resin used for the shell. The fusion performed at the temperature condition within +50° C. of the glass transition temperature of the shell-constituting resin is preferred, because viscosity reduction of the core components does not easily occur and coalescence between the core resins hardly proceeds so that a micro-phase separated structure can be maintained and a pressure-induced plasticizing behavior works sufficiently.

The aggregated product is then separated from the aqueous medium, followed by washing and drying if necessary to form toner particles.

Alternatively, a desired toner may be formed by carrying out, after completion of the aggregation step and fusion step, an arbitrary washing step, solid-liquid separation step, and drying step. In the washing step, washing while sufficiently replacing with ion exchanged water is preferred from the viewpoint of charging property. The solid-liquid separation step is not particularly limited, but suction filtration, pressure filtration and the like are preferred from the viewpoint of productivity. The drying step is also not particularly limited, but freeze drying, flash jet drying, fluidized drying, and oscillation type fluidized drying and the like are preferred from the viewpoint of productivity.

(Electrostatic Image Developer)

The toner described above (electrostatic-image-developing toner) can be used as a developer (electrostatic image developer). There is no particular limitation imposed on this developer insofar as it contains the toner. Its composition can be varied as needed, depending on the using purpose. A one-part type developer is available by using the toner alone, while two-part type developer is available by using the toner in combination with a carrier.

The carrier usable for the developer in the exemplary embodiment is not particularly limited and conventionally known carriers can be used whether the toner is colored or colorless. Examples may include magnetic particles such as iron powder, ferrite, iron oxide powder, and nickel; resin-coated carriers obtained using magnetic particles as a core material and coating the surface thereof with a resin such as styrene resin, vinyl resin, ethylene resin, rosin resin, polyester resin or melamine resin or wax such as stearic acid to form a resin coat layer; and resin-dispersed carriers obtained by dispersing a conductive material in a matrix resin.

Examples of the coating resin/matrix resin used for the carrier include, though not limited to, polyethylene, polypropylene, polystyrene, polyvinyl acetate, polyvinyl alcohol, polyvinyl butyral, polyvinyl chloride, polyvinyl ether, polyvinyl ketone, vinyl chloride/vinyl acetate copolymer, styrene/acrylic acid copolymer, straight silicone resin made of an organosiloxane bond or modified product thereof fluororesin, polyester, polycarbonate, phenolic resin, and epoxy resin.

Examples of the conductive material include, but not limited to, metals such as gold, silver, and copper and further, carbon black, titanium oxide, zinc oxide, barium sulfate, aluminum borate, potassium titanate, and tin oxide.

Examples of the core material of the carrier include magnetic metals such as iron, nickel, and cobalt, magnetic oxides such as ferrite and magnetite, and glass beads. The core material is preferably a magnetic material when it is used for the carrier in a magnetic brush method.

The volume average particle size of the core material of the carrier is usually from 10 to 500 μm, preferably from 30 to 100 μm.

In order to coat the surface of the core material of the carrier with the resin, a method of coating the surface of the core material with a coating layer forming solution obtained by dissolving the above coating resin and, if necessary, various additives in a proper solvent can be employed. Although there is no particular limitation imposed on the solvent, an appropriate solvent may be selected as needed in consideration of the coating resin to be used, coating aptitude, or the like.

Specific examples of the resin coating method include a dipping method in which the core material of the carrier is dipped in a coating layer forming solution, a spray method in which a coating layer forming solution is sprayed onto the surface of the core material of the carrier, a fluidized bed method in which a coating layer forming solution is atomized to the core material of the carrier while maintaining the material in a floating state by using an air flow, and a kneader coater method in which the core material of the carrier and a coating layer forming solution are mixed in a kneader coater, followed by removal of the solvent.

The toner of the exemplary embodiment and the carrier in the developer of the exemplary embodiment are mixed at an invisible toner: carrier ratio (weight ratio) falling within a range of from about 1:100 to 30 to 100, more preferably from about 3:100 to 20:100.

Although no particular limitation is imposed on the preparation process of the developer, mixing in a V blender is, for example, employed.

(Toner Cartridge, Process Cartridge, Image Forming Method, and Image Forming Apparatus)

The toner cartridge of the exemplary embodiment is characterized in that it contains the electrostatic-image-developing toner of the exemplary embodiment.

The process cartridge of the exemplary embodiment, on the other hand, is characterized in that it is equipped with a developing unit for housing therein an electrostatic image developer and at the same time, developing an electrostatic latent image formed on the surface of a latent image support by using the electrostatic image developer to form a toner image and at least one unit selected from the group consisting of the latent image support, a charging unit for charging the surface of the latent image support therewith, and a cleaning unit for removing the toner which has remained on the surface of the latent image support; and it is detachably mounted on an image forming apparatus.

The toner cartridge of the exemplary embodiment is detachably mounted on an image forming apparatus and it houses therein at least the electrostatic-image-developing toner of the exemplary embodiment. This means that in an image forming apparatus having a constitution enabling attachment and removal of a toner cartridge, the toner cartridge of the exemplary embodiment having the toner of the exemplary embodiment housed therein is used.

The toner cartridge may be a cartridge having both toner and carrier housed therein, or alternatively it may be separated into a cartridge housing only toner therein and a cartridge housing only a carrier therein.

The process cartridge of the exemplary embodiment houses the electrostatic-image-developing toner of the exemplary embodiment therein, can be detachably attached to an image forming apparatus, is equipped with a developing unit, and is also equipped with at least one unit selected from the group consisting of a latent image support, a charging unit, and a cleaning unit. It may include a neutralization unit or another member if necessary.

Known constitutions may be employed as the toner cartridge and the process cartridge. For example, Japanese Patent Laid-Open No. 2008-209489 and Japanese Patent Laid-Open No. 2008-233736 are reference documents.

The image forming method of the exemplary embodiment is characterized in that it includes a charging step for charging at least a latent image support, a latent image forming step for forming an electrostatic latent image on the surface of the latent image support, a developing step for developing the electrostatic latent image formed on the surface of the latent image support with a toner or an electrostatic image developer to form a toner image, a transferring step for transferring the toner image formed on the surface of the latent image support to the surface of a transfer-receiving material, a fixing step for fixing the toner image transferred to the surface of the transfer-receiving material, and an image density controlling step for detecting a concentration of the toner from a color difference between a reference toner image and the latent image support containing a phthalocyanine pigment and controlling a supply amount of the toner to the latent image support, wherein the toner is the electrostatic-image-developing toner of the exemplary embodiment or the electrostatic image developer is the electrostatic image developer of the exemplary embodiment.

The image forming apparatus of the exemplary embodiment is characterized in that it includes a latent image support, a charging unit for charging the latent image support, an exposing unit for exposing the charged latent image support to form an electrostatic latent image on the latent image support, a developing unit for developing the electrostatic latent image with a developer to form a toner image, a transferring unit for transferring the toner image from the latent image support to a transfer-receiving material, a fixing unit for fixing the toner image, and an image density controlling unit for detecting a concentration of a toner from a color difference between a reference toner image and the latent image support containing a phthalocyanine pigment and controlling a supply amount of the toner to the latent image support, wherein as the developer, the electrostatic-image-developing toner of the exemplary embodiment or the electrostatic image developer of the exemplary embodiment is used.

The image forming apparatus of the exemplary embodiment will next be described in detail.

The image forming apparatus of the exemplary embodiment is an apparatus for forming a color toner image on the surface of a recording medium in accordance with an electrophotographic system by using a color toner containing at least a thermoplastic resin and a colorant, and transferring and fixing the toner (invisible toner) of the exemplary embodiment onto or around the color toner image to give gloss to the image. As will be described later, the color toner image and the invisible toner image may be formed simultaneously on the surface of a recording medium.

The electrostatic-image-developing toner of the exemplary embodiment is suited as an invisible toner for giving a good gloss image to the color toner image by being transferred and fixed onto or around the color toner image. In this case, it is preferred that the image forming method has further a color toner image forming step for forming a color toner image on the surface of a latent image support, a transferring step for transferring the color toner image to the surface of a transfer-receiving material, and a fixing step for fixing the color toner image transferred to the surface of the transfer-receiving material. The latent image support on which a toner image is formed using the toner of the exemplary embodiment and the latent image support on which a color toner image is formed may be the same or different, but preferably different.

When the electrostatic-image-developing toner of the exemplary embodiment is used as the invisible toner, the image forming apparatus of the exemplary embodiment preferably has, further, a developing unit for developing the latent image support to form a color toner image, a transferring unit for transferring the color toner image from the latent image support to the transfer-receiving material, and a fixing unit for fixing the color toner image.

The image forming apparatus will hereinafter be described referring to a drawing.

FIG. 1 is a schematic constitution view illustrating one example of the image forming apparatus of the exemplary embodiment. An image forming apparatus 50 illustrated in FIG. 1 can be divided roughly into two parts, that is, a toner image forming apparatus for forming a color toner image (which may hereinafter be called "toner image forming apparatus" simply) (reference numerals from 2 to 16) and a toner image forming apparatus for transferring and fixing the toner of the exemplary embodiment (which may hereinafter be called "gloss providing apparatus") (reference numerals from 20 to 33). They are linked via a conveyer 19.

In the toner image forming apparatus, a document 1 to be read is exposed to light emitted from an illuminator 2. Light reflected from the document 1 is read by a color scanner 3. The signal is sent to an image processor (image signal forming apparatus) 4, where it is separated into Yellow Y, Magenta M, Cyan C, and Black K, An image signal for controlling exposure is sent to an optical system (ROS) 6 which is an exposure apparatus.

In the optical system (ROS) 6, a laser diode 5 emits light for each color component and the surface of a photoreceptor (latent image support) 8 is exposed to light X corresponding to the image of each color component. The photoreceptor 8 is, at the surface thereof, charged uniformly with a charging unit 7 while rotating in a direction of Arrow A, exposed through the optical system (ROS) 6, and subjected to development with developing units 9 to 12.

In the case of Yellow Y color, for example, light separated into a Yellow Y color component by the image processor 4 is irradiated to the surface of the photoreceptor 8 by the optical system (ROS) 6. The surface of the photoreceptor 8 has already been charged uniformly by the charging unit 7 so that a site exposed to light is charged into a reverse polarity to form a latent image. The latent image on the surface of the photoreceptor 8 is developed by a color toner of Yellow Y color through a yellow developing unit 9. The photoreceptor 8 then rotates in a direction of Arrow A and the developed latent image is transferred to the surface of an intermediate transfer belt (intermediate receiving member) 13 by using an electrostatic attractive force of a transfer corotron 14. The photoreceptor 8 after transfer rotates further in a direction of Arrow A and is charged, at the surface thereof, uniformly with the charging unit 7 for subsequent image formation of another color.

Similar operation to that of Yellow Y color is then performed for each of Magenta M, Cyan C and Black K. Latent images are developed successively by a magenta developing unit 10, a cyan developing unit 11, and a black developing unit 12 and they are stacked on the intermediate transfer belt 13. The intermediate transfer belt 13 rotates in a direction of Arrow B with the rotation of the photoreceptor 8 at the time of transfer of each color and after completion of the transfer, it rotates in a reverse direction to return to the original place. When a next color is transferred, it is transferred to the color toner image formed previously. After completion of stacking of all the four colors, the belt rotates in a direction of Arrow B and is sent to a nip portion sandwiched between transfer rolls (secondary transferring apparatuses) 15, 16. At the nip portion, the recording medium 17 on which an image is to be formed is inserted in the direction of Arrow C while being in contact with the intermediate transfer belt 13. The stacked color toner images are then transferred onto the surface of the recording medium 17 by the electrostatic action of the transfer rolls 15,16.

The recording medium 17 having the color toner image transferred thereto is conveyed to the gloss providing unit by using the conveyer 19.

Conventionally known electrophotographic toner image forming apparatuses are employed as a unit for forming a color toner image on the surface of a recording medium. Toner image forming apparatuses known per se are used insofar as they satisfy the object, that is, formation of a color image on the surface of a recording medium.

The recording medium on which the color toner image has been formed using the toner image forming apparatus is usually conveyed one after another to a gloss providing unit. As the conveyer for conveying the recording medium to the gloss providing apparatus, a conveyer known per se is used. Since the gloss providing apparatus in the exemplary embodiment serves as a fixing apparatus, the color toner image may be conveyed to the gloss providing apparatus without fixing or it may be fused and fixed by a known fixing apparatus prior to conveying. The conveying rate of the conveyer is preferably constant so that a conveyer usable for it is, for example, a conveyer driven while inserting the recording medium between a pair of rubber rolls rotating at a constant rotational speed or a conveyer in which a belt made of a rubber or the like is wound around a pair of rolls one of which is driven with a motor or the like at a constant rate and the recording medium is placed on the belt substantially horizontally and driven at a constant rate can be used. When an unfixed color toner image is formed, the latter conveyer is preferred in order to prevent distortion of the color toner image.

In the image forming apparatus illustrated in FIG. 1, the toner image forming apparatus and the gloss providing apparatus are linked via the conveyer, but the exemplary embodiment is not limited thereto. For example, after completion of the transfer of the toner image to the intermediate transfer belt 13 by using the black developing unit 12, the photoreceptor 8 is exposed depending on a desired invisible toner image. The invisible toner image is then developed and formed on the intermediate transfer belt 13, and then the color toner image and the invisible toner image are simultaneously transferred to the recording medium 17.

A color toner for forming the color toner image will hereinafter be described in detail.

No particular limitation is imposed on the color toner insofar as it is a commonly used one containing at least a binder resin and a colorant. As components other than the binder resin and the colorant, those similar to <other additives> described in the invisible toner of the exemplary embodiment may be added internally or externally.

As the binder resin, conventionally known resins are usable without particular limitation. Specific examples include polyester resin, styrene/acrylic copolymer, and styrene/butadiene copolymer.

As the colorant, conventionally known colorants are used without no particular limitation. Yellow (Y) color colorants include Benzidine yellow, Quinoline yellow and Hanza yellow; magenta (M) color colorants include Rhodamine B, Rose bengal and Pigment red; cyan (C) color colorants include Phthalocyanine blue, Aniline blue, and Pigment blue; and black (K) color colorants include carbon black, Aniline black, and blend of color pigments.

Typical color toner is obtained by attaching fine particles of an external agent having an average particle size of from about 5 to 100 nm, e.g., inorganic fine particles such as silicon oxide, titanium oxide or aluminum oxide and/or fine resin particles such as polymethyl methacrylate (PMMA) or polyvinyl difluoride (PVDF) to particles obtained by dispersing the colorant in the binder resin and having a volume average particle size of from 1 to 15 μm (which are usually called "toner particles" or "colored particles").

No particular limitation is imposed on the preparation process of the toner particles constituting the color toner. A kneading and grinding process, as well as the wet process as described in the invisible toner of the exemplary embodiment, may be employed. Since the color toner typically has a relatively low viscosity, the wet process is preferred as in the invisible toner of the exemplary embodiment.

No particular limitation is imposed on the recording medium onto which the toner of the exemplary embodiment or the above color toner is transferred and fixed or formed. Not only commonly used copy paper, plain paper and coarse paper but also resin sheet such as OHP paper can be used. Any medium in the sheet form on which an image can be formed through an electrophotographic system may be useful as the recording medium of the exemplary embodiment Of the elements defining the toner of the exemplary embodiment, details of the steps for transferring and fixing or forming the toner of the exemplary embodiment and the color toner on the recording medium will be described later in the section "gloss providing apparatus".

In the exemplary embodiment, the gloss providing apparatus has a photoreceptor (latent image support) 24, a charging unit 25 for charging the photoreceptor 24, an exposing unit 26 for exposing the charged photoreceptor 24 to form an electrostatic latent image on the photoreceptor 24, a transferring unit 29 for transferring the toner image from the photoreceptor 24 to the surface of an intermediate transfer belt (transfer-receiving material) 20, and a fixing unit 22 for transferring and fixing the toner image formed on the intermediate transfer belt 20 to the recording medium 17.

The gloss providing apparatus has further an image density controlling unit 40 for detecting the toner concentration from a color difference between a reference toner image and the latent image support and controlling an amount of the toner to be supplied to the latent image support. The photoreceptor 24 preferably contains a phthalocyanine pigment. It is particularly preferred that the photoreceptor 24 contains the phthalocyanine pigment as a charge generating agent.

These steps and units will next be described in detail.

(Photoreceptor (Latent Image Support))

No particular limitation is imposed on the photoreceptor 24 and conventionally known ones are usable without any problem. It may be either a single-layer structure or a multilayer structure of a function separation type. With regard to the material, the photoreceptor 24 is either an inorganic photoreceptor such as selenium or amorphous silicon or an organic photoreceptor (so-called OPC). It is preferably an organic photoreceptor.

Figure 2A:
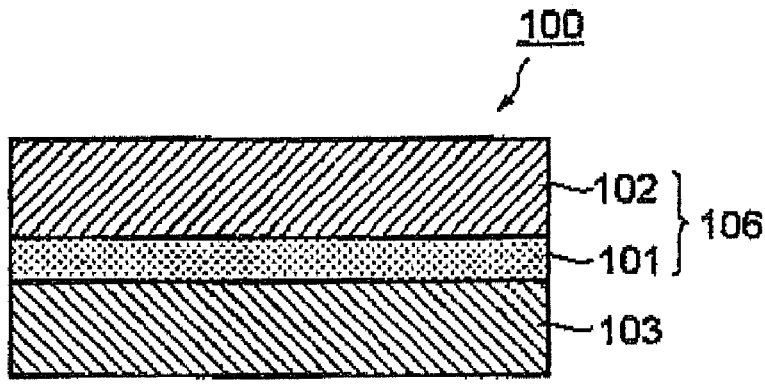
FIGS. 2A to 2C are schematic cross-sectional views of a photoreceptor usable in the exemplary embodiment.

FIG. 2A is a schematic cross-sectional view illustrating the first exemplary embodiment of the photoreceptor. The photoreceptor 100 illustrated in FIG. 2A is equipped with a stacked photosensitive layer 106 having respective functions in a layer containing a charge generating agent (charge generation layer 101) and a layer containing a charge transport material (charge transport layer 102). It has, on a conductive support 103 thereof, the charge generation layer 101 and the charge transport layer 102 stacked successively one over another. The charge generation layer 101 contains, as a charge generating agent, preferably a phthalocyanine pigment, more preferably a hydroxygallium phthalocyanine pigment.

Each constituent of the electrophotographic photoreceptor 100 will next be described in detail.

Examples of the conductive support 103 include those made of a metal such as aluminum, copper, iron, zinc or nickel; those obtained by vapor depositing a metal such as aluminum, copper, silver, platinum, palladium, titanium, nickel-chromium, stainless steel or copper-indium on a substrate such as polymer-made sheet, paper, plastic or glass to impart conductivity thereto; those obtained by vapor depositing a conductive metal compound such as indium oxide or tin oxide on the substrate to impart conductivity; those obtained by laminating a metal foil on the substrate to impart conductivity thereto; and those obtained by dispersing carbon black, indium oxide, tin oxide-antimony oxide powder, metal powder, or copper iodide in a binder resin and applying the resulting dispersion onto the substrate to impart conductivity thereto. The conductive support 103 may be in any of drum form, sheet form or plate form.

When a metal pipe material is used as the conductive support 103, the surface may be remained as such, but it is preferred to roughen the surface of the material in advance by surface treatment such as mirror cutting, etching, anodizing, rough cutting, centerless grinding, sand blasting, wet horning or coloring treatment. The treatment to roughen the surface of the material serves to prevent formation of grain-like density spots due to coherent light within the photoreceptor which will otherwise occur by the use of a coherent light source such as a laser beam.

The charge generation layer 101 contains a charge generating agent and a binder resin.

Examples of the charge generating agent to be used in the exemplary embodiment include azo pigments such as chlorodian blue, quinone pigments such as anthanthrone bromide and pyrenequinone, quinocyanine pigments, perylene pigments, indigo pigments, bisbenzimidazole pigments, pyrrolopyrrole pigments, phthalocyanine pigments, azlenium salts, squarium, and quinacridone. OF the above charge generating agents, phthalocyanine pigments are most effective as a charge generating agent to be used for a photoreceptor for digital recording such as laser printer. Hydroxygallium phthalocyanine pigments are especially preferred, but the charge generating agent is not limited thereto in the exemplary embodiment.

The phthalocyanine pigment, preferably hydroxygallium phthalocyanine pigment has a complementary relationship with a yellow pigment contained in the toner of the exemplary embodiment and has a blue color. As a result, incorporation of a trace amount of a yellow pigment markedly improves detection sensitivity through an optical sensor, which will be described later.

The exemplary embodiment will next be described with the hydroxygallium phthalocyanine pigment as an example. As the hydroxygallium phthalocyanine pigment suited for use in the exemplary embodiment and having excellent sensitivity and environment stability, hydroxygallium phthalocyanine pigments having strong diffraction peaks at Bragg angles ($2\theta \pm 0.2°$) of 7.5°, 9.9°, 12.5°, 16.3°, 18.6°, 22.1 °, 24.1°, 25.1° and 28.3° in Cuk$\alpha$ characteristics X ray are selected. The above crystal type hydroxygallium phthalocyanine pigment is prepared by dissolving, in an acid such as sulfuric acid or trifluoroacetic acid, chlorogallium phthalocyanine available by heating condensation of 1,3-diisoiminoindoline and gallium trichloride in a solvent, re-precipitating in an aqueous alkaline solution such as aqueous ammonia or aqueous sodium hydroxide solution or cold water to effect acid pasting (preparation of hydroxygallium phthalocyanine Type I), and then carrying out crystal conversion by treating it with an organic solvent such as amide (N,N-dimethylformamide, N,N-dimethylacetamide, or N-methylpyrrolidone), an ester (such as ethyl acetate, n-butyl acetate, or i-amyl acetate), a ketone (such as acetone, methyl ethyl ketone, or cyclohexanone), or dimethylsulfoxide.

Of the hydroxygallium phthalocyanine pigments in the exemplary embodiment, hydroxygallium phthalocyanine having the highest peak in a range of from 810 to 839 nm in a spectral absorption spectrum in a wavelength region of from 600 to 900 nm is most preferred because it contains no coarse particles or it is effective as fine pigment particles. Such a hydroxygallium phthalocyanine pigment can be obtained by wet grinding the I-type hydroxygallium phthalocyanine pigment, which has been obtained by the acid pasting treatment, with a solvent, thereby causing crystal conversion. In the preparation process of the hydroxygallium phthalocyanine pigment, the wet grinding treatment is preferably carried out using a grinding apparatus with spherical media having an outer diameter of from 0.1 mm to 3.0 mm, more preferably from 0.2 mm to about 2.5 mm. When the outer diameter of the media is greater than 3.0 mm, the particle size of the pigment does not decrease due to deterioration in grinding efficiency and as a result, the pigment is likely to form an aggregate. When it is less than 0.1 mm, on the other hand, the hydroxygallium phthalocyanine pigment cannot be separated from the media easily. In addition, media not spherical but having another shape such as a cylindrical or irregular shape tend to lower a grinding efficiency, wear during grinding, and deteriorate the properties of the hydroxygallium phthalocyanine pigment due to the resulting wear dust mixed therein as an impurity.

Although any material may be used for the media, materials which do not easily generate image quality defects even if they are mixed in the pigment are preferred. Preferred examples include glass, zirconia, alumina, and agate.

Although any material may be used for the container, materials which do not easily generate image quality defects even if they are mixed in the pigment are preferred. Preferred examples include glass, zirconia, alumina, agate, polypropylene, TEFLON (trade mark; product of Dupont), and polyphenylene sulfide. Further, the inside surface of a container made of a metal such as iron or stainless steel may be lined with glass, polypropylene, TEFLON (trade name) or polyphenylene sulfide.

The amount of the media may vary depend on the type of an apparatus used, but is generally about 50 parts by weight or greater, preferably from 55 parts to about 100 parts by weight based on 1 part by weight of the I-type hydroxygallium phthalocyanine pigment. When the amount of the media is the same, a decrease in the outer diameter of the media leads to an increase in the density of the media in the apparatus, an increase in the viscosity of the mixture solution, and a change in grinding efficiency. Therefore, it is preferred to control the using amount of the media and using amount of the solvent as needed, depending on a decrease in the outer diameter of the media, to carry out the wet process at an optimum mixing ratio.

The wet grinding treatment is performed at preferably from 0 to 100° C., more preferably from 5 to 80° C., still more preferably from 10° C. to 50° C. Temperatures falling within the above range enable to maintain an adequate crystal transition rate, facilitating the formation of particles having an appropriate particle size.

As the solvent to be used for the wet grinding treatment, the above organic solvents can be used. The amount of the solvent is usually from 1 to 200 parts by weight, preferably from 1 to 100 parts by weight based on 1 part by weight of the hydroxygallium phthalocyanine pigment.

As an apparatus used in the wet grinding treatment, apparatuses using the media as a dispersion medium, such as vibration mill, automatic mortar, sand mill, dyno mill, coball mill, attritor, planetary ball mill or ball mill can be used.

The progress speed of the crystal conversion can be influenced strongly by the scale, agitating speed and the material of the media of the wet grinding step. The process is continued until the original crystal form of hydroxygallium phthalocyanine is converted into the desired crystal form thereof so as to have the maximum peak within a range of from 810 to 839 nm in a spectral absorption spectrum in a wavelength region of from 600 to 900 nm while monitoring the crystal conversion state by measuring the absorption wavelength of the solution to be wet ground. The wet grinding treatment is performed from 5 to 500 hours, more preferably from 7 to 300 hours. Treatment for 5 hours or greater is preferred because crystal conversion proceeds sufficiently, leading to improvement in electrophotographic properties and sensitivity. On the other hand, treatment for not greater than 500 hours is preferred because an influence of a grinding stress is small so that deterioration in sensitivity hardly occurs. Moreover, it improves productivity and at the same time suppresses occurrence of problems such as mixing of wear dust of the media. Wet grinding time set to fall within the above range enables to complete the wet grinding treatment after obtaining uniformly ground hydroxygallium phthalocyanine particles and, when a plurality of lots are subjected to wet grinding treatment in repetition, suppress variation in quality among them.

Examples of the binder resin include polycarbonate, polystyrene, polysulfone, polyester, polyimide, polyester carbonate, polyvinyl butyral, methacrylate polymer, vinyl acetate homopolymer or copolymer, cellulose ester, cellulose ether, polybutadiene, polyurethane, phenoxy resin, epoxy resin, silicon resin, and fluororesin and partially crosslinked products thereof. These binder resins may be used either singly or in combination.

The mixing ratio (weight ratio) of the charge generating agent to the binder resin in the charge generation layer 101 is preferably from 40:1 to 1:4, more preferably from 20:1 to 1:2. The amounts of the charge generating agent falling within the above range are preferred because of excellent dispersibility of the charge generating agent and also excellent sensitivity of the photoreceptor.

When another layer such as charge transport layer 102 is formed over the charge generation layer 101, it is preferred to select a combination of the binder resin of the charge generation layer 101 and a solvent of a coating solution to be applied onto the charge generation layer 101 as needed so as to prevent dissolution or swelling of the charge generation layer 101 in or with a solvent to be added to the coating solution. The binder resin of the charge generation layer 101 and the binder resin of the charge transport layer 102 which will be described later are preferably close to each other in a refractive index. More specifically, the difference in refractive index between them is preferably 1 or less. When binder resins close to each other in refractive index are used, reflection of light on the interface between the charge generation layer 101 and the charge transport layer 102 is suppressed, thereby improving the interference fringe preventing effect.

The charge generation layer 101 can be obtained by adding a charge generating agent and a binder resin to a predetermined solvent, mixing and dispersing the resulting mixture by using a sand mill, colloid mill, attritor, dyno mill, jet mill, co-ball mill, roll mill, ultrasonic disperser, Gaulin homogenizer, microfluidizer, ultimaizer or milder to obtain a coating solution, applying the resulting coating solution through blade coating, wire bar coating, spray coating, dip coating, bead coating, air knife coating or curtain coating, and then drying. The solvent used for forming the coating solution of the charge generation layer 101 is, for example, methanol, ethanol, n-butanol, benzyl alcohol, acetone, methyl ethyl ketone, cyclohexanone, methyl acetate, n-butyl acetate, dioxane, tetrahydrofuran, methylene chloride, chloroform, toluene, xylene, chlorobenzene, dimethylformamide, dimethylacetamide, or water. One or more of these may be used either singly or in combination. The film thickness of the charge generation layer 101 thus obtained is preferably from 0.05 to 5 μm, more preferably from 0.1 to 1 μm from the standpoint of achieving good electrical properties and image quality. The film thickness of the charge generation layer 101 of 0.05 μm or greater can achieve high sensitivity, while that not greater than 5 μm can achieve good chargeability. The film thicknesses within the above range are therefore preferred.

The charge transport layer 102 contains a charge transporting material and a binder resin. No particular limitation is imposed on the charge transporting material used for the charge transport layer 102 insofar as it has a charge transporting function. Examples include hole transporting substances, e.g., oxadiazole derivatives such as 2,5-bis(p-diethylaminophenyl)-1,3,4-oxadiazole; pyrazoline derivatives such as 1,3,5-triphenylpyrazoline, 1-[pyridyl-(2)]-3-(p-diethylaminostyryl)-5-(p-diethylaminostyryl)pyrazoline; aromatic tertiary amino compounds such as triphenylamine, tri(p-methyl) phenylamine, N,N'-bis(3,4-dimethylphenyl)biphenyl-4-amine, dibenzylaniline, and 9,9-dimethyl-N,N'-di(p-tolyl) fluorenone-2-amine; aromatic tertiary diamino compounds such as N,N'-diphenyl-N,N'-bis(3-methylphenyl)-[1,1-biphenyl]-4,4'-diamine; 1,2,4-triazine derivatives such as 3-(4'-dimethylaminophenyl)-5,6-di-(4'-methoxyphenyl)-1,2,4-triazine; hydrazone derivatives such as 4-diethylaminobenzaldehyde-1,1-diphenylhydrazone, 4-diphenylaminobenzaldehyde-1,1-diphenylhydrazone, and [p-(diethylamino)phenyl](1-naphthyl)phenylhydrazone; quinazoline derivatives such as 2-phenyl-4-styrylquinazoline; benzofuran derivatives such as 6-hydroxy-2,3-di(p-methoxyphenyl)benzofuran; α-stilbene derivatives such as p-(2,2-diphenylvinyl)-N,N'-diphenylaniline; enamine derivatives; carbazole derivatives such as N-ethylcarbazole, and poly-N-vinylcarbazole and derivatives thereof; electron-transporting materials, e.g., quinone compounds such as chloranil, bromoanile, anthraquinone; tetracyanoquinodimethane compounds; fluorenone compounds such as 2,4,7-trinitrofluorenone, 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, 2,5-bis(4-diethylaminophenyl)-1,3,4-oxadiazole; xanthone compounds; thiophene compounds; and diphenoquinone compounds such as 3,3',5,5'-tetra-t-butyldiphenoquinone. Further, polymers having a principal structure of the above compounds in the main chain or side chain thereof are also usable. These charge transporting materials may be used either singly or in combination.

As the binder rein to be used for the charge transport layer 102, known ones are usable without particular limitation, but resins capable of forming an electric insulating film are preferred. Examples include polycarbonate resin, polyester resin, methacrylic resin, acrylic resin, polyvinyl chloride resin, polyvinylidene chloride resin, polystyrene resin, polyvinyl acetate resin, styrene-butadiene copolymer, vinylidene chloride-acrylonitrile copolymer, vinyl chloride-vinyl acetate copolymer, vinyl chloride-vinyl acetate-maleic anhydride copolymer, silicon resin, silicon-alkyd resin, phenol-formaldehyde resin, styrene-alkyd resin, poly-N-vinylcarbazole, polyvinylbutyral, polyvinyl formal, polysulfone, casein, gelatin, polyvinyl alcohol, ethyl cellulose, phenolic resin, polyamide, carboxy-methyl cellulose, vinylidene chloride polymer wax, and polyurethane. These binder resins may be used either singly or in combination. In particular, polycarbonate resin, polyester resin, methacrylic resin, and acrylic resin are preferred because of excellent compatibility with the charge transporting material, solubility in a solvent and strength.

The mixing ratio (weight ratio) of the binder resin and the charge transporting material is set arbitrarily so as to cause neither deterioration in electrical properties nor deterioration in film strength.

The thickness of the charge transport layer 102 is preferably from 5 to 50 μm, more preferably from 10 to 35 μm.

As the solvent to be used for a coating solution for forming the charge transport layer 102, ordinarily employed organic solvents such as dioxane, tetrahydrofuran, methylene chloride, chloroform, chlorobenzene, and toluene are used either singly or in combination. The coating solution for forming the charge transport layer 102 is applied in a conventional manner such as blade coating, wire bar coating, spray coating, dip coating, bead coating, air knife coating, or curtain coating.

Figure 2B:
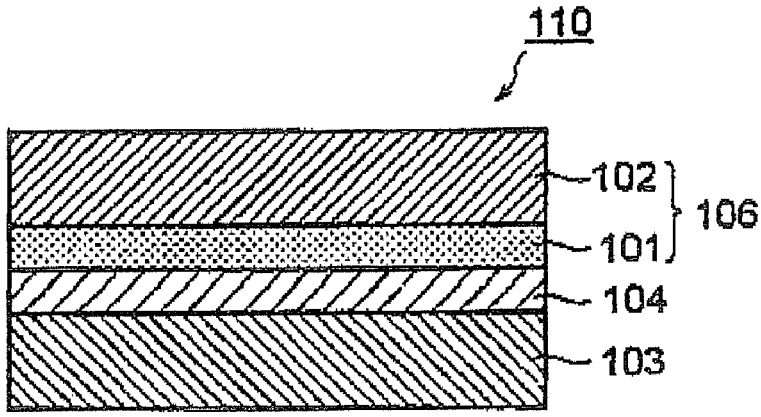

FIG. 2B is a schematic cross-sectional view illustrating a second embodiment of an electrophotographic photoreceptor to be used in the exemplary embodiment. The electrophotographic photoreceptor illustrated in FIG. 2B has a similar structure to that of the electrophotographic photoreceptor 100 illustrated in FIG. 2A except that the former one is equipped with an undercoat layer 104 between the conductive support 103 and the photosensitive layer 106.

The undercoat layer 104 has a function of preventing injection of charges from the conductive support 103 to the photosensitive layer 106 at the time when the photosensitive layer 106 is charged. The undercoat layer 104 also functions as an adhesion layer for integrally adhering and fixing the photosensitive layer 106 to the conductive support 103. Further, the undercoat layer 104 has a function of preventing light reflection on the conductive support 103.

The undercoat layer 104 is made of a material selected arbitrarily from binder resins, organic or inorganic powders, and electron transporting materials. As the binder resin, known materials can be used. Examples include polymeric resin compounds, e.g., acetal resins such as polyvinyl butyral, polyvinyl alcohol resin, casein, polyamide resin, cellulose resin, gelatin, polyurethane resin, polyester resin, methacrylic resin, acrylic resin, polyvinyl chloride resin, polyvinyl acetate resin, vinyl chloride-vinyl acetate-maleic anhydride resin, silicon resin, silicon-alkyd resin, phenol-formaldehyde resin, and melamine resin; zirconium chelate compounds, titanium chelate compounds, aluminum chelate compounds, titanium alkoxide compounds, organic titanium compounds, and silane coupling agents. These compounds may be used singly, as a mixture of a plurality of these compounds, or a polycondensate of them. Of those, zirconium chelate compounds and silane compiling agents are preferred because they have excellent performances, for example, a residual potential is low, a potential change due to an environmental change is small, and a potential change is small even after repeated use.

Examples of the silane coupling agent include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethylmethoxysilane, N,N-bis(β-hydroxyethyl)-γ-aminopropyltriethoxysilane, and γ-chloropropyltrimethoxysilane. Of these, vinyltriethoxysilane, vinyltris(2-methoxyethoxysilane), 3-methacryloxypropyltrimethoxysilane, 3-glycidoxypropyltrimethoxysilane, 2-(3,4-etpoxycyclohexyl)ethyltrimethoxysilane, N-2-(aminoethyl)-3-aminopropyltrimethoxysilane, N-2-(aminoethyl)-3-aminopropylmethyl dimethoxysilane, 3-aminopropyltriethoxysilane, N-phenyl-3-aminopropyltrimethoxysilane, 3-mercaptopropyltrimethoxysilane, and 3-chloropropyltrimethoxysilane are especially preferred.

Examples of the titanium chelate compound include tetraisopropyl titanate, tetra-n-butyl titanate, butyl titanate dimer, tetra(2-ethylhexyl)titanate, titanium acetylacetonate, polytitanium acetyl acetonate, titanium octylene glycolate, titanium lactate ammonium salt, titanium lactate, titanium lactate ethyl ester, titanium triethanol aminate, and polyhydroxy titanium stearate.

Examples of the aluminum chelate compound include aluminum isopropylate, monobutoxyaluminum diisopropylate, aluminum butyrate, diethylacetoacetate aluminum diisopropylate, and aluminum tris(ethyl acetoacetate).

In the undercoat layer 104, fine powders of various organic or inorganic compounds are added for the purpose of improving electrical properties and light scattering properties. In particular, white pigments such as titanium oxide, zinc oxide, zinc flower, zinc sulfide, white lead, and lithopone, inorganic pigments as extender pigments such as alumina, calcium carbonate, and barium sulfate, polytetrafluoroethylene resin particles, benzoguanamine resin particles, and styrene resin particles are effective. The particle size of the powders to be added is from 0.01 μm to 2 μm. The fine powders are added as needed, and the amount thereof is preferably from 10 to 90 wt. %, more preferably from 30 to 80 wt. %, based on the total amount of solids of the undercoat layer 104.

It is also effective to incorporate in the undercoat layer 104 the electron transporting substances and electron transporting pigments, which have been described above, from the standpoint of reducing the residual potential and improving environmental stability. The thickness of the undercoat layer 104 is preferably from 0.01 to 30 μm, more preferably from 0.05 to 25 μm.

When a coating solution for forming the undercoat layer 104 is prepared, fine powder substances, if they are added, are added to a solution obtained by dissolving therein resin components, followed by dispersing treatment. For the dispersing treatment, a roll mill, a ball mill, a vibration ball mill, an attritor, a sand mill, a colloid mill or a paint shaker may be employed.

The undercoat layer 104 is formed by applying the coating solution for forming the undercoat layer 104 on the conductive support 103, and drying it. The application is performed in a conventional manner, for example, blade coating, wire bar coating, spray coating, dip coating, bead coating, air knife coating, or curtain coating.

Figure 2C:
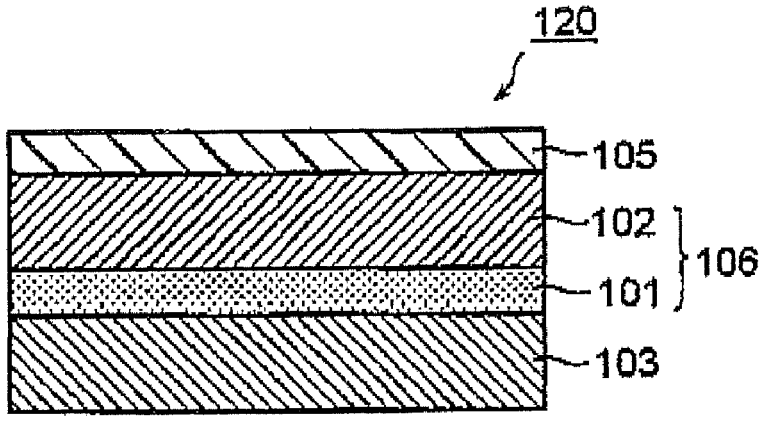

FIG. 2C is a schematic cross-sectional view illustrating a third exemplary embodiment of a photoreceptor to be used in the present exemplary embodiment. The electrophotographic photoreceptor 120 illustrated in FIG. 2C has a similar constitution to that of the electrophotographic receptor 100 illustrated in FIG. 2A except that it has a protective layer 105 on the photosensitive layer 106.

The protective layer 105 is used for preventing a chemical change of the charge transport layer 102 during charging the electrophotographic photoreceptor 120 and for further improving the mechanical strength of the photosensitive layer 106. This protective layer 105 is formed by applying onto the photosensitive layer 106 a coating solution obtained by incorporating a conductive material in an appropriate binder resin. The conductive material is not particular limited and examples of it include metallocene compounds such as N,N'-dimethylferrocene, aromatic amine compounds such as N,N'-diphenyl-N,N'-bis(3-methylphenyl)-(1,1'-biphenyl)-4,4-diamine, molybdenum oxide, tungsten oxide, antimony oxide, tin oxide, titanium oxide, indium oxide, carrier of a solid solution between tin oxide and antimony or between barium sulfate and antimony oxide, mixtures of the above metal oxides, mixtures obtained by mixing the above metal oxide in single particles of titanium oxide, tin oxide, zinc oxide, or barium sulfate, and materials obtained by coating the above metal oxide on the single particles of titanium oxide, tin oxide, zinc oxide or barium sulfate.

As the binder resin to be used for the protective layer 105, known resins such as polyamide resin, polyvinyl acetal resin, polyurethane resin, polyester resin, epoxy resin, polyketone resin, polycarbonate resin, polyvinyl ketone resin, polystyrene resin, polyacrylamide resin, polyimide resin, and polyamide-imide resin can be used. These resins may be used after crosslinking to each other if necessary.

The thickness of the protective layer 105 is preferably from 1 to 20 μm, more preferably from 2 to 10 μm.

The coating solution for forming the protective layer 105 may be applied by a conventional manner such as blade coating, wire bar coating, spray coating, dip coating, bead coating, air knife coating, or curtain coating. As the solvent used for the coating solution for forming the protective layer 5, commonly used organic solvents such as dioxane, tetrahydrofuran, methylene chloride, chloroform, chlorobenzene, and toluene may be used either singly or in combination. Use of a solvent sparingly dissolving therein the photosensitive layer 106 to be coated with the coating solution is preferred.

Figure 3A:
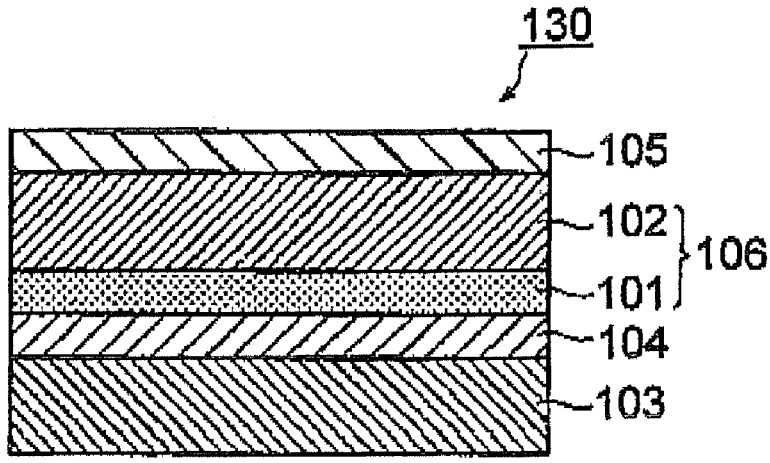
FIGS. 3A and 3B are schematic cross-sectional views of another photoreceptor usable in the exemplary embodiment.

Preferred exemplary embodiments of the photoreceptor to be used in the present exemplary embodiment were described specifically, but the photoreceptor is not limited thereto. For example, as the photoreceptor 130 illustrated in FIG. 3A, it may have the undercoat layer 104 between the conductive support 103 and the photosensitive layer 106 and have further the protective layer 105 on the photosensitive layer 106.

Figure 3B:
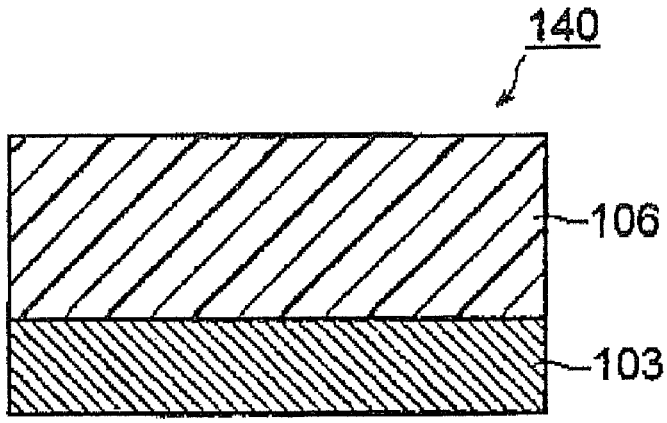

In the above photoreceptors 100, 110, and 120, the photosensitive layer 106 has a stack structure. For example, as in the photoreceptor 140 illustrated in FIG. 3B, the photosensitive layer 106 may have a single layer structure. In this case, the photoreceptor may be equipped with the undercoat layer 104 between the conductive support 103 and the photosensitive layer 106 or equipped with both the undercoat layer 104 and the protective layer 105.

(Charging Unit)

As the charging unit 25, units known per se such as contact charging apparatuses using a conductive or semiconductive roller, brush, film or rubber blade and non-contact charging apparatuses using corotron charging or scorotron charging making use of corona discharge are usable.

(Exposing Unit)

As the exposing unit 26, known exposing units such as combination of a semiconductor laser and a scanner, a laser ROS (Raster Output Scanner) composed of optical components, an LED head, or a halogen lamp are used. Use of the laser ROS or LED head is preferred in order to realize a preferred embodiment for changing, as desired, an exposed image region, that is, a position of the surface of a recording medium on which an invisible toner is formed.

(Invisible-Toner-Image Signal Forming Apparatus)

As the invisible-toner-image signal forming apparatus 27, any conventionally known unit may be used insofar as it can form a signal enabling formation of an invisible toner image at a desired position on the surface of the recording medium 17. The invisible-toner-image signal forming apparatus 27 may be an apparatus for forming an invisible-toner-image formation signal based on an image data output from the image processing apparatus 4 of the toner image formation apparatus described above.

(Developing Unit)

As the developing unit 28, a conventionally known developing apparatus can be used whether the toner is one-component type or two-component type insofar as the developing unit has a function of forming an invisible toner image uniformly on the surface of the photoreceptor 24.

(Transferring Unit and Fixing Unit)

As the transferring unit 29, conventionally known units can be used. Examples include a unit for forming an electric field between the photoreceptor 24 and the intermediate transfer belt 20 by using a conductive or semiconductive roller, brush, film or rubber blade to which a voltage has been applied and thereby transferring charged invisible toner particles; and a unit for corona-charging the back side of the intermediate transfer belt 20 with a corotron or scorotron charger utilizing corona discharge and thereby transferring charged invisible toner particles.

(Intermediate Transfer Belt)

In FIG. 1, the gloss providing apparatus of the exemplary embodiment is equipped with the intermediate transfer belt 20 in the form of an endless belt suspended on a plurality of rolls 30, 32, and 33 and the fixing unit 22. The fixing unit 22 is a unit for inserting therein the intermediate transfer belt 20 on the surface of which the invisible toner image has been formed and the recording medium 17 on the surface of which the color toner image has been formed, while superposing them and bringing them into contact by heating or application of pressure.

As the intermediate transfer belt 20, a fixing belt in an endless form obtained using a polymer film such as polyimide is employed. In order to form a predetermined amount of an invisible toner image stably, the intermediate transfer belt 20 preferably has a resistance adjusted to a predetermined value by dispersing therein a conductive additive such as conductive carbon particles or conductive polymer. The intermediate transfer belt 20 is not only in an endless form but also in various forms such as web or sheet, which is fed, for example, in the web form as needed and taken up on the opposite side. Use of the belt in an endless form as in this example is however preferred.

The surface of the intermediate transfer belt 20 is preferably coated with a silicon resin and/or fluororesin from the standpoint of releasing property. In addition, the surface of the intermediate transfer belt 20 has preferably a glossiness of 60 or greater as measured using a 75° gloss meter from the standpoint of smoothness.

A region in which the invisible toner image is to be formed is, in this example, an entire image region covering the entire color toner image on the surface of the recording medium 17. In the exemplary embodiment, however, the region is not limited thereto but it may be, for example, an entire surface of the recording medium 17. Alternatively, only a region of the color toner image required to have particularly a high gloss such as photographic image may be selected. In order to prevent occurrence of irregularities due to toner particles of the color toner image, it is also possible to change the toner height of the invisible toner image so as to make the height uniform, depending on the toner height of the color toner image; or to form almost no or utterly no invisible toner image on the color toner image by forming the invisible toner image only in a region where no color toner image is formed. It is also possible to form the invisible toner image prior to the formation of the color toner image. The term "on or around the color toner image" as used herein means all of these modes.

As the fixing unit 22 for inserting therein the intermediate transfer belt 20 on which the invisible toner image has been formed and the recording medium 17 on which the color toner image has been formed, while superposing them and bringing them into contact by heating or application of pressure, conventionally known ones can be used. In the exemplary embodiment, the fixing unit 22 preferably conveys the intermediate transfer belt 20 on which the invisible toner image has been formed and the recording medium 17 on which the color image has been formed while sandwiching them between a pair of rolls (heating roll 30 and pressure roll 31) which are to be driven at a constant speed in directions of Arrows C and C' as illustrated in FIG. 1, and heating and applying a pressure to them. The rolls 30 and 31 are heated, at the surface thereof, to a melting temperature of the invisible toner, for example, by a method of disposing a heat source (not illustrated) at the center of the rolls. At the same time, the rolls 30 and 31 are brought into contact under pressure via the intermediate transfer belt 20. One or both of the rolls 30 and 31 has(have), on the surface thereof, preferably a silicon rubber or fluororubber layer and a nip region to be heated and pressurized is preferably within a range of from about 1 to 8 mm.

The fixing unit is not limited to the above one and fixing may be performed only by heating or only by application of pressure.

As illustrated in FIG. 1, the intermediate transfer belt 20 in the endless belt form is supported rotatably by a plurality of rolls 30, 32, and 33 including the heating roll 30 and the pressure roll 31 is brought into contact, under pressure, with the heating roll 30 via the intermediate transfer belt 20.

In this example, as the heating roll 30 and the pressure roll 31, a roll obtained by coating the surface of a metal core made of aluminum with an elastic layer (thickness: 2 mm) made of a silicon rubber to have a predetermined outer diameter (40 mm) may be employed. Inside these heating roll 30 and pressure roll 31, an illustrated halogen lamp of from 300 to 350 W is provided as a heating source, and they are heated from inside so as to raise the surface temperature of the heating roll 30 to a predetermined temperature.

The heating roll 30 and the pressure roll 31 are brought into contact with each other under pressure via the intermediate transfer belt 20. In this example, a predetermined load is applied from an unillustrated pressurizing unit to give a width of a pressure contact portion (nip portion) of 8 mm. The intermediate transfer belt 20 is suspended on the heating roll 30, releasing roll 32 and follower roll 33 and is rotatably driven in the direction of Arrow D at a predetermined transfer rate (in this example, 60 mm/sec) by using the heating roll 30 rotatably driven in a direction of Arrow C by an unillustrated driving source. In this example, a belt obtained by coating, with a silicon rubber layer of 30 μm thick, the outer surface of an endless film having a thickness of 80 m and made of a thermosetting polyimide resin is used as the intermediate transfer belt 20.

A description will next be made of a step of conveying the recording medium 17 having thereon the color toner image by the conveyer 19, introducing it in the gloss providing apparatus having the structure as described above, and then providing it with image gloss.

The recording medium 17 on the surface of which the color toner image has been formed (transferred) is introduced at the pressure contact portion (nip portion) between the heating roll 30 and the pressure roll 31 to be pressure contacted via the intermediate transfer belt 20 while facing the color toner image on the side of the heating roll 30.

Figure 4:
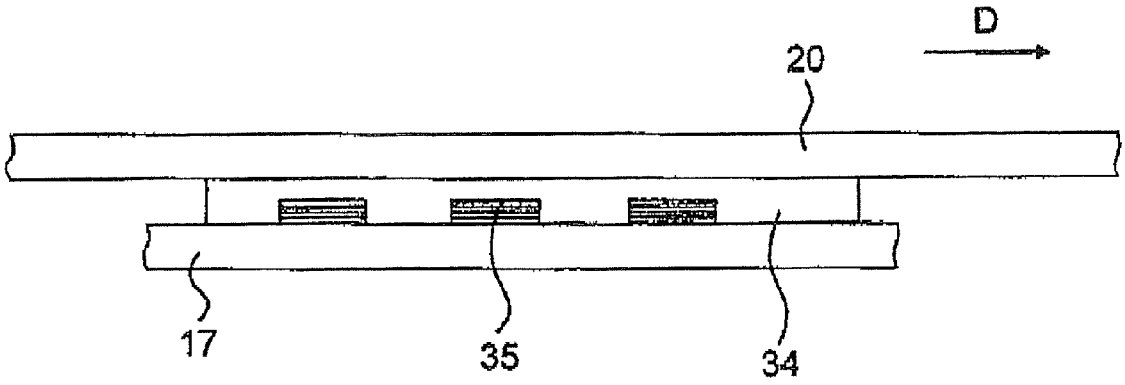
FIG. 4 is a schematic enlarged cross-sectional view schematically illustrating the state between an intermediate transfer belt 20 and a recording medium 17 passing through a pressure contact portion of a heating roll 30 and a pressure roll 31 in the exemplary embodiment.

FIG. 4 is a schematic enlarged cross-sectional view schematically showing the state between the intermediate transfer belt 20 and the recording medium 17 when they pass through the pressure contact portion between the heating roll 30 and the pressure roll 31. In FIG. 4, indicated at 34 is the invisible toner image supported by the intermediate transfer belt 20 and indicated at 35 is the color toner image formed on the recording medium 17, and the pair of rolls 30 and 31 is omitted from the drawing. As illustrated in FIG. 4, as soon as the color toner image 35 is heat melted on the surface of the recording medium 17, the invisible toner image 34 formed on the surface of the intermediate transfer belt 20 is fused on or around the color toner image 35 by heating and melting to coat the entire portion with the invisible toner image.

At the pressure contact portion between the heating roll 30 and the pressure roll 31, the color toner image 35 and the invisible toner image 34 are heated to substantially a temperature of from about 120 to 130° C. and melted. The recording medium 17 on which the invisible toner image 34 and the color toner image 35 have been fusion bonded is conveyed in a direction of Arrow D together with the intermediate transfer belt 20 while keeping the adhesion state of the invisible toner image 34 to the surface of the intermediate transfer belt 20. Then, the recording medium 17 is released by the release roll 32 while making use of its own body (rigidity).

After completion of the releasing step, the residual toner and the like are removed from the surface of the intermediate transfer belt 20 by using an unillustrated cleaner, if necessary, to prepare for the subsequent fixing step.

(Image Density Controlling Unit)

A main image density controlling unit in the exemplary embodiment will next be described.

Figure 5:
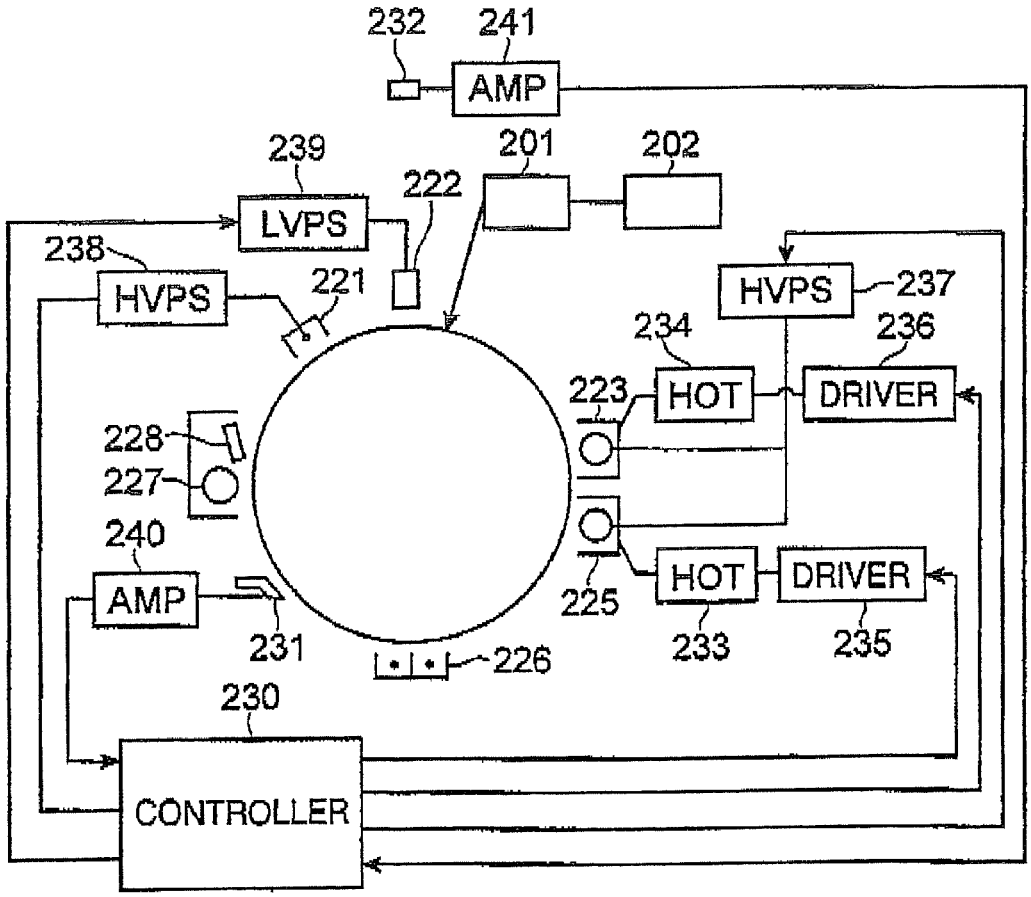
FIG. 5 is an overall schematic view of a gloss providing apparatus equipped with an image density controlling unit in the exemplary embodiment.

FIG. 5 is an overall schematic view of a gloss providing apparatus equipped with an image density controlling unit. In FIG. 5, a developing apparatus has a primary developing unit and a subsidiary developing unit and does not have an intermediate transfer belt. In FIG. 5, indicated at 201 is a developing apparatus, 202 an invisible-toner-image signal forming apparatus, 220 a photoreceptor, 221 a charging unit, 222 an ISIL (charge removal apparatus), 223 a subsidiary developing unit, 225 a primary developing unit, 226 a transferring unit, 227 a brush for toner disturber, 228 a cleaning blade, 230 a controller, 231 an optical sensor, 232 an AE sensor, 233 and 234 toner dispense motors, 235 and 236 drivers, 237 and 238 high voltage power circuits, 239 a low voltage power circuit, and 240 and 241 amplifiers. In FIG. 5, the photoreceptor 220 is charged to a predetermined potential by discharging from the charging unit 221 power supplied from the high voltage power circuit 238. On the other hand, based on the signal from the invisible-toner-image signal forming apparatus 202, the developing apparatus 201 irradiates laser to the photoreceptor 220 to form an image at a predetermined position. As a result an electrostatic latent image corresponding to a desired invisible toner region is formed on the photoreceptor 220. This electrostatic latent image is developed by the subsidiary developing unit 223 or the primary developing unit 225, followed by transfer and recording to the recording medium by using the transferring unit 226 made of a transfer corotron or a detach corotron.

The image density controlling unit will next be described in detail.

Figure 6:
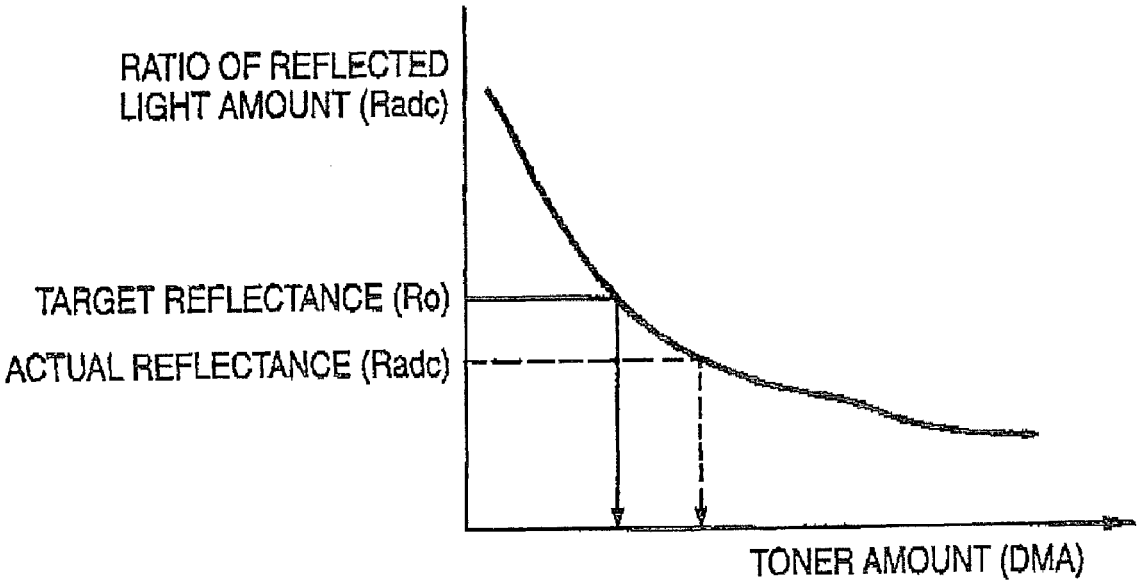
FIG. 6 illustrates the relationship between a ratio of reflected light amount and a toner amount in the exemplary embodiment.

The image controlling unit in the exemplary embodiment is an image density controlling unit called ADC. A non-image region of the photoreceptor 220 charged to a predetermined potential by using the charging unit 221 is exposed to light from LSIL 222, which has been power supplied from the low voltage power circuit 239, to form a dark potential portion in a predetermined region. The predetermined region is then exposed to form a reference potential portion. The reference potential portion is developed by using the subsidiary developing unit 223 or the primary developing unit 225 into a toner image. The density of the toner image is optically detected by using the optical sensor 231 and the toner image density thus detected is input in the controller 230. A reflected light from the clean surface of the photoreceptor 220 is input in the controller 230 in advance so that Rade (Vpatch/Vclean), that is, a ratio of reflected light amount from the toner image portion to that from the clean surface is calculated. Between the ratio Rede and the toner amount per unit area, (DMA), there is a relationship as shown in FIG. 6. The Rade at which a predetermined toner amount can be provided is designated as a target reflectance (Ro) and by controlling the operation of the toner dispense motor 233 or 234 via the driver 235 or 236 so that the detected value of the optical sensor 231 becomes the target reflectance (RO), toner supply is controlled.

No particular limitation is imposed on the method how to control the image density insofar as it can control the supply amount of the toner to the photoreceptor so as to give a predetermined image density. The supply amount of the toner to the developing unit may be controlled or the exposure intensity may be controlled.

The present inventors have found that use of an invisible toner may cause a control failure of image density because the toner is not colored and no color difference appears between an image portion and a non-image portion so that an optical sensor cannot detect the color difference. According to the exemplary embodiment, a color difference with the photosensor is increased, which facilitates detection of an image and improves the correction of the toner concentration. In particular, when the photoreceptor contains a phthalocyanine pigment, addition of a small amount of a yellow pigment to the toner increases a difference in the reflected light amount between the photoreceptor and the invisible toner, improves the detection sensitivity, and enables sufficient control of the image density.

The image forming apparatus of the exemplary embodiment was described with some preferred examples, but the exemplary embodiment is not limited to the above examples. The constitution of the exemplary embodiment may be replaced based on the conventionally known finding or a technology discovered or invented newly for the exemplary embodiment insofar as it has the constitution of the exemplary embodiment.

EXAMPLES

The exemplary embodiment will hereinafter be described more specifically by Examples, but the exemplary embodiment is not limited to or by the following Examples.

(Measurement of Pigment Content)

A pigment content can be determined by using, in combination, GC-MS (Gas Chromatograph Mass Spectrum), TG-DTA (Thermal Gravimetry-Differential Thermal Analysis), IPC-OES (Inductively Coupled Plasma-Optical Emission spectrometry) and atomic absorption analysis.

The content of a quinacridone pigment can be determined, for example, by using IPC-MS, atomic absorption analysis or the like and a structural analysis through pyrolysis GC/MS as described in the analysis example of UBE Scientific Analysis Laboratory (http://www.ube-ind.co.jp/usal/service/organic/o032b.pdf) in combination.

The content of C.I. Pigment Yellow 74, which is a monoazo pigment, can be determined by analyzing the atom derived from the pigment such as an amount of a chlorine atom in the pigment through IPC (Inductively-Coupled Plasma Analysis) or atomic absorption analysis. A relationship between the charged amount and detected amount of the pigments determined by the above analysis are shown in the following table.

TABLE 1

| Charged amount (ppm) | Detected amount (ppm) |
|---|---|
| 0 | 0.0 |
| 1 | 0.9 |
| 2 | 2.0 |
| 5 | 4.9 |
| 19 | 17.1 |
| 20 | 19.4 |
| 23 | 20.8 |
| 25 | 24.3 |
| 50 | 49.1 |
| 60 | 59.0 |
| 78 | 70.5 |

(Measurement of Molecular Weight)

The weight average molecular weight Mw and number average molecular weight Mn are measured by gel permeation chromatography (GPC) under the following conditions. Measurement is conducted by feeding a solvent (tetrahydrofuran) at a flow rate of 1.2 ml per minute at 40° C. and pouring 3 mg, in terms of a sample weight, of a tetrahydrofuran sample solution having a concentration of 0.2 g/20 ml. In the measurement of the molecular weight of the sample, measurement conditions are selected so that the molecular weight of the sample falls within a range in which the logarithm of the molecular weight of a calibration curve plotted from several monodisperse polystyrene standard samples and count value form a straight line.

The reliability of the measurement results is verified because an NBS706 polystyrene standard sample has:

weight average molecular weight $Mw=28.8\times10^4$ and number average molecular weight $Mn=13.7\times10^4$ under the above measurement conditions.

As the column of GPC, "TSK-GEL, GMH" (trade name; product of TOSOH) which satisfies the above conditions is employed.

(Measurement of Melting Temperature (Tm) and Glass Transition Temperature (Tg))

The melting temperature and glass transition temperature of a resin is measured in accordance with ASTM D3418 by using a differential scanning calorimeter ("DSC-50", trade name; product of Shimadzu Corporation) equipped with an automatic tangent line processing system. The following are measurement conditions:

Sample: from 3 to 15 mg, preferably from 5 to 10 mg

Measuring method: The sample is put in an aluminum pan, while a blank aluminum pan is used as a reference.

Temperature curve: Heating I (from 20° C. to 180° C., heating rate: 10° C./min))

The glass transition temperature is determined from an endothermic curve of the temperature curve measured at the heating time. The glass transition temperature means a temperature at which the derivative value of the endothermic curve becomes the maximum.

(Measurement of Acid Value)

The acid value is measured in accordance with JIS K-0070-1992.

—Synthesis of Crystalline Polyester Resin (1)—

Decanedicarboxylic acid: 100 mol %

Nonanediol: 100 mol %

Dibutyl tin oxide (catalyst): 0.25 wt. %

After the above components are put in a three-necked flask which has been dried by heating, pressure reduction is performed to convert the air in the flask into an inert atmosphere with a nitrogen gas. The resulting mixture is mechanically stirred and refluxed at 180° C. for 5 hours.

The reaction mixture is then heated gradually to 230° C. under reduced pressure and stirred for 2 hours. When the mixture became viscous, air cooling is performed to terminate the reaction. As a result, a crystalline polyester resin (1) is synthesized.

Molecular weight measurement (based on polystyrene) by gel permeation chromatography reveals that the weight average molecular weight (Mw) of the crystalline polyester resin (1) thus obtained is 24,000 and the number average molecular weight (Mn) is 7,600. It has an acid value of 10.5 mgKOH/g.

The results of the measurement of the melting temperature (Tm) of the crystalline polyester resin (1) using a differential scanning calorimeter (DSC) in accordance with the above measuring method reveals that it shows a clear endothermic peak and the endothermic peak temperature is 72.3° C.

—Synthesis of Non-Crystalline Polyester Resin (1)—

2 Mol ethylene oxide adduct of bisphenol A: 10 mol %

1 Mol propylene oxide adduct of bisphenol A: 90 mol %

Terephthalic acid: 40 mol %

Fumaric acid: 40 mol %

Dodecenylsuccinic acid: 20 mol %

The above components are charged in a flask equipped with a stirrer, a nitrogen inlet, a temperature sensor, and a rectifying column. The temperature is raised to 190° C. over 1 hour. After confirmation that the reaction system is stirred uniformly, 0.9 wt. % of tin distearate is charged. The temperature is raised to 240° C. over 6 hours while distilling off water thus generated. Dehydration condensation reaction is continued for further 3 hours at 240° C. to obtain a non-crystalline polyester resin (1) having a glass transition temperature of 60° C., an acid value of 13.6 mgKOH/g, a weight average molecular weight of 16,000, and a number average molecular weight of 6,000.

—Synthesis of Non-Crystalline Polyester Resin (2)—

2 Mol ethylene oxide adduct of bisphenol A: 50 mol %

1 Mol propylene oxide adduct of bisphenol A: 50 mol %

Trimellitic anhydride: 7 mol %

Terephthalic acid: 65 mol %

Dodecenylsuccinic acid: 28 nmol %

As in the synthesis of the non-crystalline polyester resin (1), the reaction is effected using the monomers other than trimellitic anhydride until the softening temperature became 110° C. The temperature is then reduced to 190° C. and 7 mol % of trimellitic anhydride is added in portions. The reaction is continued for one hour at the same temperature to obtain a non-crystalline polyester resin (2) having a glass transition temperature of 56° C., an acid value of 11.3 mgKOH/g, a weight average molecular weight of 78,000, and a number-average molecular weight of 7,800.

—Preparation of Resin Particle Dispersion (1)—

Crystalline polyester resin (1): 100 parts by weight

Methyl ethyl ketone: 60 parts by weight

Isopropyl alcohol: 15 parts by weight

In a separable flask, methyl ethyl ketone is charged and then, the above resin is charged gradually. The resulting mixture is stirred with "Three-one Motor" (trade name) to thoroughly dissolve the resin in methyl ethyl ketone to obtain an oil phase. The temperature of the separable flask containing the resulting oil phase is adjusted to 65° C. by using a water bath and a 10% aqueous ammonia solution is added dropwise through a dropper to the oil phase thus stirred to give a total amount of 5 parts by weight. Further, 230 parts by weight of ion exchanged water is added dropwise at a rate of 10 ml/min to cause phase inversion emulsification. The solvent is removed while reducing the pressure through an evaporator to obtain a resin particle dispersion (1) made of the crystalline polyester resin (1). The resin particles have a volume average particle size of 145 nm. The solid content of the resin particles is adjusted to 20% with ion exchanged water.

—Preparation of Resin Particle Dispersion (2)—

Non-crystalline polyester resin (1); 100 parts by weight

Methyl ethyl ketone: 60 parts by weight

Isopropyl alcohol: 15 parts by weight

In a separable flask, methyl ethyl ketone is charged and then, the above resin is charged gradually. The resulting mixture is stirred with "Three-one Motor" (trade name) to thoroughly dissolve the resin in methyl ethyl ketone to obtain an oil phase. The temperature of the separable flask containing the resulting oil phase is adjusted to 40° C. by using a water bath and a 10% aqueous ammonia solution is added dropwise through a dropper to the oil phase thus stirred to give a total amount of 3.5 parts by weight. Further, 230 parts by weight of ion exchanged water is added dropwise at a rate of 10 ml/min to cause phase inversion emulsification. The solvent is removed while reducing the pressure through an evaporator to obtain a resin particle dispersion (2) made of the non-crystalline polyester resin (1). The resulting resin particles have a volume average particle size of 175 nm. The solid content of the resin particles is adjusted to 20% with ion exchanged water.

—Preparation of Resin Particle Dispersion (3)—

In a similar manner to that employed in the preparation of the resin particle dispersion (1) except that the non-crystalline polyester resin (2) is used instead of the non-crystalline polyester resin (1), a resin particle dispersion (3) is obtained. The resulting resin particles have a volume average particle size of 165 nm. The solid content of the resin particles is adjusted to 20% with ion exchanged water.

—Preparation of Releasing Agent Particle Dispersion—

Carnauba wax (melting temperature: 83° C.): 60 parts by weight

Ionic surfactant "Neogen RK" (product of Daiichi Kogyo Seiyaku): 1.8 parts by weight Ion exchanged water: 238 parts by weight The above components are heated to 100° C. After the resulting mixture is dispersed sufficiently with "ULTRA TURRAX T50", trade name; product of IKA, the resulting dispersion is dispersed by heating to 110° C. for 1 hour by using a pressure pump type Gaulin homogenizer to obtain a releasing agent particle dispersion having a center diameter of 180 nm and a solid content of 20%.

—Preparation of Colorant Particle Dispersion—

Yellow pigment ("PY74", trade name; product of Clariant Japan): 50 parts by weight Ionic surfactant "Neogen RK" (trade name; product of Daiichi Kogyo Seiyaku): 5 parts by weight Ion exchanged water: 195 parts by weight After the above components are mixed and dispersed using a homogenizer ("ULTRA TURRAX", trade name; product of IKA) for 10 minutes, the resulting dispersion is subjected to dispersing treatment for 15 minutes under a pressure of 250 MPa by using "Ultimaizer" (trade name of counter collision type wet grinding system: product of Sugino Machine) to obtain a yellow colorant particle dispersion having colorant particles with a median particle size of 130 nm and a solid content of 20%.

—Preparation of Toner 1—

Resin particle dispersion (1): 110 parts by weight

Resin particle dispersion (2): 420 parts by weight

Resin particle dispersion (3): 420 parts by weight

Releasing agent particle dispersion: 50 parts by weight

Colorant particle dispersion: 0.024 part by weight

In a round-bottom stainless flask, 2.0 parts by weight of an ionic surfactant "Neogen RK" (trade name) is added to the above components and the resulting mixture is stirred to sufficiently mix/disperse the resulting mixture. The reaction dispersion is adjusted to pH 3.5 by the dropwise addition of a 1N aqueous nitric acid solution. To the reaction mixture is added 0.40 part by weight of polyaluminum chloride and a dispersing operation is continued by using "ULTRA TURRAX". The resulting dispersion is heated to 48° C. while stirring in the flask placed in a heating oil bath. After the reaction mixture is retained at 48° C. for 40 minutes, a mixture of 100 parts by weight of the resin particle dispersion (2) and 100 parts by weight of the resin particle dispersion (3) is added slowly.

Then, after adjustment of the reaction system to pH 7.0 with a 1N aqueous solution of sodium hydroxide, the stainless flask is hermetically sealed. The temperature is raised gradually to 90° C. while continuing stirring by using a magnetic seal and the mixture is retained at 90° C. for 3 hours.

After completion of the reaction, the reaction mixture is cooled and then filtered, followed by filtration and sufficient washing with ion exchanged water. Solid-liquid separation is then performed using Nutsche suction filtration, followed by redispersion in 1 L of ion exchanged water of 40° C. and stirring/washing for 15 minutes at 30 rpm.

The above operation is repeated five times. When the pH of the filtrate became 7.5 and electrical conductivity became 7.0 μS/cmt, solid-liquid separation is performed through a No. 5A filter paper by using Nutsche suction filtration. Vacuum drying is then continued for 12 hours to obtain Toner 1.

Measurement of the particle size by using a Coulter counter reveals that Toner 1 has a volume average size $D_{50}$ of 5.9 μm and a particle size distribution coefficient GSDv of 1.25. The shape factor SF1 of the particles determined by the shape observation through "LUZEX" (trade name) is 136 and the particles are in potato form.

—Preparation of Toner 2—

In a similar manner to Toner 1 except that the weight ratio of the particle dispersions is changed to the following one, Toner 2 is prepared.

Resin particle dispersion (1): 110 parts by weight

Resin particle dispersion (2): 420 parts by weight

Resin particle dispersion (3): 420 parts by weight

Releasing agent particle dispersion: 50 parts by weight

Colorant particle dispersion: 0.0052 part by weight

—Preparation of Toner 3—

In a similar manner to Toner 1 except that the weight ratio of the particle dispersions is changed to the following one, Toner 3 is prepared.

Resin particle dispersion (1): 110 parts by weight

Resin particle dispersion (2): 420 parts by weight

Resin particle dispersion (3): 420 parts by weight

Releasing agent particle dispersion: 50 parts by weight

Colorant particle dispersion: 0.051 part by weight

—Preparation of Toner 4—

In a similar manner to Toner 1 except that the weight ratio of the particle dispersions is changed to the following one, Toner 4 is prepared.

Resin particle dispersion (1): 47 parts by weight

Resin particle dispersion (2): 451 parts by weight

Resin particle dispersion (3): 451 parts by weight
Releasing agent particle dispersion: 50 parts by weight
Colorant particle dispersion: 0.024 part by weight —Preparation of Toner 5—

In a similar manner to Toner 1 except that the weight ratio of the particle dispersions is changed to the following one, Toner 5 is prepared.

Resin particle dispersion (1): 285 parts by weight
Resin particle dispersion (2): 332 parts by weight
Resin particle dispersion (3): 332 parts by weight
Releasing agent particle dispersion: 50 parts by weight
Colorant particle dispersion: 0.024 part by weight —Preparation of Toner 6—

In a similar manner to Toner 1 except that the weight ratio of the particle dispersions is changed to the following one, Toner 6 is prepared.

Resin particle dispersion (1): 475 parts by weight
Resin particle dispersion (2): 238 parts by weight
Resin particle dispersion (3): 237 parts by weight
Releasing agent particle dispersion: 50 parts by weight
Colorant particle dispersion: 0.024 part by weight —Preparation of Toner 7—

In a similar manner to Toner 1 except that the weight ratio of the particle dispersions is changed to the following one, Toner 7 is prepared.

Resin particle dispersion (1): None
Resin particle dispersion (2): 475 parts by weight
Resin particle dispersion (3): 475 parts by weight
Releasing agent particle dispersion: 50 parts by weight
Colorant particle dispersion: 0.024 part by weight Resin particle dispersion (3): 420 parts by weight
Releasing agent particle dispersion: 50 parts by weight
Colorant particle dispersion: 0.08 part by weight —Preparation of Toner 10—

Non-crystalline polyester resin (1): 84 parts by weight
Non-crystalline polyester resin (2): 84 parts by weight
Crystalline polyester resin (1): 22 parts by weight
Carnauba wax: 10 parts by weight
Yellow pigment ("PY74", trade name; product of Clariant Japan): 0.0048 part by weight After the above components are kneaded in a Banbury mixer, the kneaded mass is finely ground in a jet mill to prepare Toner 10 having an average particle size of 7.5 μm as measured by a Coulter counter. It has been confirmed from the observation through a scanning electron microscope that Toner 10 has an irregular shape (SF1=170).

<Addition of External Additive>

After 100 parts of Toner 1, 0.8 part of hydrophobic titania having an average particle size of 15 nm and treated with decylsilane, 1.1 part of hydrophobic silica ("NY50", trade name; product of Nippon Aerosil) having an average particle size of 30 mm, and 1.0 part by hydrophobic silica ("X24", trade name; product of Shin-Etsu Chemical) having an average particle size of 100 nm are blended for 10 minutes by using a Henschel mixer at a peripheral speed of 32 m/s, coarse particles are removed by using a sieve with 45-μm openings to obtain External-additive containing invisible toner 1.

In a similar manner except for the use of Toners 2 to 10 instead of Toner 1, External-additive containing toners 2 to 10 are prepared, respectively.

TABLE 2

| | Resin particle dispersion (1) Crystalline polyester resin | | Resin particle dispersion (2) Non-crystalline polyester resin | | Resin particle dispersion (3) Non-crystalline polyester resin | | Pigment dispersion C.I. Pigment Yellow 74 | | Releasing agent particle dispersion | Configuration of mother toner particles | | |
|---|---|---|---|---|---|---|---|---|---|---|---|---|
| | Parts by weight | % in binder resin | Parts by weight | % in binder resin | Parts by weight | % in binder resin | Parts by weight | ppm | Parts by weight | D50 (μm) | GSDv | SF1 |
| Toner 1 | 110 | 11.6 | 420 | 44.2 | 420 | 44.2 | 0.024 | 23 | 50.0 | 5.9 | 1.25 | 136 |
| Toner 2 | 110 | 11.6 | 420 | 44.2 | 420 | 44.2 | 0.0052 | 5 | 50.0 | 5.9 | 1.25 | 136 |
| Toner 3 | 110 | 11.6 | 420 | 44.2 | 420 | 44.2 | 0.051 | 50 | 50.0 | 5.9 | 1.25 | 136 |
| Toner 4 | 47 | 5.0 | 451 | 47.5 | 451 | 47.5 | 0.024 | 23 | 50.0 | 6 | 1.23 | 138 |
| Toner 5 | 285 | 30.0 | 332 | 35.0 | 332 | 35.0 | 0.024 | 23 | 50.0 | 5.8 | 1.25 | 126 |
| Toner 6 | 475 | 50.0 | 238 | 25.1 | 237 | 24.9 | 0.024 | 23 | 50.0 | 5.7 | 1.23 | 130 |
| Toner 7 | 0 | 0.0 | 475 | 50.0 | 475 | 50.0 | 0.024 | 23 | 50.0 | 6 | 1.23 | 140 |
| Toner 8 | 110 | 11.6 | 420 | 44.2 | 420 | 44.2 | 0 | 0 | 50.0 | 5.9 | 1.25 | 136 |
| Toner 9 | 110 | 11.6 | 420 | 44.2 | 420 | 44.2 | 0.08 | 78 | 50.0 | 5.9 | 1.25 | 136 |
| Toner 10 | 84* | 44.2 | 84* | 44.2 | 22* | 11.6 | 0.0048* | 23 | 10.0 | 7.5 | 1.35 | 170 |

*With regard to Toner 10, not the amount of the dispersion but that of the resin or pigment is expressed by part(s) by weight.

—Preparation of Toner 8—

In a similar manner to Toner 1 except that the weight ratio of the particle dispersions is changed to the following one, Toner 8 is prepared.

Resin particle dispersion (1): 110 parts by weight
Resin particle dispersion (2): 420 parts by weight
Resin particle dispersion (3): 420 parts by weight
Releasing agent particle dispersion: 50 parts by weight
Colorant particle dispersion: None —Preparation of Toner 9—

In a similar manner to Toner 1 except that the weight ratio of the particle dispersions is changed to the following one, Toner 9 is prepared.

Resin particle dispersion (1): 110 parts by weight
Resin particle dispersion (2): 420 parts by weight <Preparation of Carrier>

Ferrite ("EFC-35B", trade name; product of Powdertec, weight average particle size: 35 μm): 13.5 parts by weight Toluene: 13.5 parts by weight Methyl methacrylate/perfluorooctyl methacrylate copolymer: 2.3 parts by weight (polymerization ratio 90:10, weight average molecular weight: 49,000)

Carbon black ("VXC72", trade name; product of Cabot): 0.3 part by weight

"EPOSTAR S" (trade name of melamine resin particles; product of Nippon Shokubai): 0.3 part by weight The above components except the ferrite are dispersed for one hour in a sand mill to prepare a resin coating-layer forming solution. The resulting resin coating-layer forming solution and the ferrite are charged in a vacuum degassing kneader. The resulting mixture is stirred at 60° C. for 20 minutes while reducing the pressure and a resin coat layer is formed on the ferrite. Thus, a carrier is prepared. The carrier has a volume resistance of $2\times10^{11}$ Ωcm.

<Preparation of Developer>

To 7 parts of External additive containing toner 1 is added 100 parts of the carrier, followed by mixing in a ball mill for 5 minutes to obtain Developer 1. In a similar manner except for the use of External additive containing toners 2 to 10 instead of External additive containing toner 1, Developers 2 to 10 are prepared <Preparation of photoreceptor 1>

A cylindrical Al substrate is ground with a centerless grinding apparatus, and the surface roughness thereof is adjusted to 0.6 μm in terms of Rz. The outer peripheral surface of the resulting Al substrate is degreased with an organic solvent, followed by etching for 1 minute with a 2 wt % sodium hydroxide solution, neutralization of the alkali component remaining on the surface of the Al substrate, and washing with pure water.

Next, an anodic oxide film (current density: 1.0 A/dm$^2$) is formed by anodizing the outer peripheral surface of the Al substrate with a 10 wt. % sulfuric acid solution. After washing with water, pore sealing treatment is performed by dipping the Al substrate in a 1 wt % nickel acetate solution, which has been kept at 80° C., for 20 minutes. Washing with pure water and drying treatment are then performed. In such a manner, the anodic oxide film (undercoat layer) having a film thickness of 7 μm is formed on the outer peripheral surface of the Al substrate.

Next, 1 part by weight of hydroxygallium phthalocyanine having a strong X-ray diffraction peak at a Bragg angle (2θ±0.2°) of 7.50, 9.90, 12.5°, 16.3°, 18.6°, 22.1°, 24.1°, 25.1°, and 28.3° in X-ray diffractions spectrum is mixed with 1 part by weight of polyvinyl butyral ("S-LEC BM-S", trade name, product of Sekisui Chemical) and 100 parts by weight n-butyl acetate. A coating solution obtained by dispersing the resulting mixture by the treatment with glass beads in a paint shaker for one hour is applied onto the undercoat layer by dip coating and heated and dried at 100° C. for 10 minutes to obtain a charge generation layer having a thickness of about 0.15 μm.

A coating solution obtained by dissolving 2 parts by weight of a benzidine compound and 2 parts by weight of a polymeric compound (viscosity average molecular weight=39,000) in 20 parts by weight of chlorobenzene is applied onto the charge generation layer by dip coating, followed by heat treatment at 110° C. for 40 minutes to form a charge transport layer having a film thickness of 20 μm. In such a manner, Photoreceptor 1 is obtained.

<Evaluation>

[Density Control Apparatus]

An image density is mainly controlled by a unit having an ATC sensor or that having an ADC sensor. The ATC sensor detects TC (toner concentration) from a permeability of the carrier and controls the supply amount of the toner and it is typically installed around a developing machine. The ADC sensor, on the other hand, optically detects a toner image density on a photoreceptor and controls a toner adhering amount per unit area (which is called "DMA") on a photoreceptor based on a ratio of a reflected light amount between a non-image portion (clean surface) and a toner image portion on the photoreceptor. It is typically installed around the photoreceptor.

In the test, a popularly used "Docucolor 500" (trade name; product of Fuji Xerox) having both the ADC sensor and ATC sensor is used.

[Evaluation of TMA]

Printing is performed at a processing speed fixed at 140 mm/sec by using a remodeled machine of "Docucolor 500" (trade name; product of Fuji Xerox) capable of controlling its processing speed. The toner adhering amount is adjusted to 4.5 g/m$^2$. Immediately before a solid image is transferred from the photoreceptor to the intermediate transfer medium, printing is forcibly stopped (shut down). The solid image (3 cm×4 cm) on the photoreceptor is transferred to a tape. The resulting tape is weighed to determine the toner adhering amount (TMA) on the photoreceptor.

A difference (ΔTMA) of TMA on the photoreceptor when the above operation is continuously performed 100 times is taken as an indication of the variation of the toner concentration.

The ΔTMA is evaluated in accordance with the following criteria.

A: ΔTMA is less than 0.1 mg/cm$^2$.

B: ΔTMA is 0.1 mg/cm$^2$ or greater but less than 0.15 mg/cm$^2$.

C: ΔTMA is 0.15 mg/cm$^2$ or greater but not less than 2.5 mg/cm$^2$.

D: ΔTMA is 2.5 mg/cm$^2$ or greater.

[Evaluation of Color]

Lightness of an image printed at a fixing temperature of 140° C. is evaluated using X-lite and it is taken as an indication of transparency (coloration degree in a direction of yellow color).

Evaluation is performed in accordance with the following criteria:

A: b* is less than 1.5.

B: b* is 1.5 or greater but less than 2.5.

C: b* is 2.5 or greater but less than 3.5.

D: b* is 3.5 or greater,

[Evaluation of Fixing Temperature Range]

Fixing test of Developers 1 to 10 is performed at a process speed kept at 140 mm/sec by using a remodeled "Docucolor 500" (trade name; product of Fuji Xerox) capable of controlling its speed, while changing a fixing temperature within a range of from 80 to 180° C.

The toner adhering amount is adjusted to 4.5 g/m$^2$. The temperature range enabling good toner fixing is evaluated in the following manner. After fixing an unfixed toner solid image (25 mm×25 mm), a weight having a certain weight is applied to cause bending and an image missing degree of the bent portion is graded. The lowest fixing temperature at which the grade exceeds a certain level is designated as the minimum fixing temperature; the lowest fixing temperature (hot offset) at which the toner component transfers to the fixing member is designated as the maximum fixing temperature; and the temperature between these minimum and maximum temperatures is designated as a fixing temperature region (MFT).

Evaluation is performed based on the following criteria:

A: MFT is 65° C. or greater.

B: MFT is 60° C. or greater but less than 65° C.

C: MFT is 55° C. or greater but less than 60° C.

D: MFT is less than 55° C.

[Evaluation of Cracks of Image]

In a similar manner to that described above, a solid image (toner adhering amount: 4.5 g/m$^2$) is formed under normal temperature and normal humidity environment (25° C., 50% RH) by using a remodeled "Docucolor 500" (trade name; product of Fuji Xerox) filled with Developers 1 to 10. Then, the solid image is fixed using a fixing apparatus set to similar conditions to those described above.

At the time of fixing, a fold line is formed at almost the center of the solid portion of a toner image fixed at a fixing temperature of 140° C. and a broken portion of the fixed toner image is wiped with tissue paper. A white line width (mm) is measured and is used as an indication of image crack.

The evaluation is performed in accordance with the following criteria:

A: white line width is less than 0.4 mm.

B: white line width is 0.4 mm or greater but less than 0.6 mm.

C: white line width is 0.6 mm or greater but less than 1.0 mm.

D: white line width is 1.0 mm or greater.

(Evaluation Results)

The above results are shown in Table 3.

TABLE 3

| | | Binder resin | | | Evaluation results | | | |
|---|---|---|---|---|---|---|---|---|
| | Toner | Non-crystalline resin | Crystalline resin | Yellow pigment (ppm) | ΔTMA | B* | MFT | Image crack |
| Ex. 1 | Toner 1 | 88.4 | 11.6 | 23 | A | A | A | A |
| Ex. 2 | Toner 2 | 88.4 | 11.6 | 5 | B | A | A | A |
| Ex. 3 | Toner 3 | 88.4 | 11.6 | 50 | A | B | A | A |
| Ex. 4 | Toner 4 | 95.0 | 5.0 | 23 | A | A | C | A |
| Ex. 5 | Toner 5 | 70.0 | 30.0 | 23 | A | A | A | C |
| Ex. 6 | Toner 6 | 50.0 | 50.0 | 23 | A | A | A | D |
| Ex. 7 | Toner 7 | 100.0 | 0.0 | 23 | A | A | D | A |
| Ex. 8 | Toner 10 | 88.4 | 11.6 | 23 | C | B | C | C |
| Comp. Ex. 1 | Toner 8 | 88.4 | 11.6 | 0 | D | A | A | A |
| Comp. Ex. 2 | Toner 9 | 88.4 | 11.6 | 78 | A | D | A | A |

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An electrostatic-image-developing toner, comprising:

a binder resin; and a yellow pigment in an amount of from about 5 to about 50 ppm.

2. The electrostatic-image-developing toner according to claim 1, wherein the binder resin contains a polyester resin.

3. The electrostatic-image-developing toner according to claim 1, wherein the binder resin contains a polyester resin in an amount of from about 70 to about 100 wt. %.

4. The electrostatic-image-developing toner according to claim 1, wherein the binder resin contains a crystalline polyester resin in an amount of from about 5 to about 30 wt. %.

5. The electrostatic-image-developing toner according to claim 2, wherein the polyester resin contains a non-crystalline polyester resin having a bisphenol structure.

6. The electrostatic-image-developing toner according to claim 1, wherein the yellow pigment is selected from the group consisting of monoazo pigments, disazo pigments and benzimidazolone disazo pigments.

7. The electrostatic-image-developing toner according to claim 1, wherein the yellow pigment is selected from the group consisting of C.I. Pigment Yellow 74, C.I. Pigment Yellow 93 and C.I. Pigment Yellow 180.

8. The electrostatic-image-developing toner according to claim 1, further comprising:

a releasing agent that contains carnauba wax.

9. A process for preparing the electrostatic-image-developing toner according to claim 1, the process comprising:

in a dispersion in which binder resin particles and yellow pigment particles are dispersed, aggregating the binder resin particles and the yellow pigment particles to obtain aggregated particles; and fusing the aggregated particles by heating.

10. An electrostatic image developer, comprising:

the electrostatic-image-developing toner according to claim 1; and a carrier.

11. A toner cartridge, comprising:

the electrostatic-image-developing toner according to claim 1.

12. A process cartridge, comprising:

a developing unit that houses therein the electrostatic image developer according to claim 10 and develops an electrostatic latent image formed on a surface of a latent image support with the electrostatic image developer to form a toner image; and at least one unit selected from the group consisting of the latent image support, a charging unit that charges the surface of the latent image support and a cleaning unit that removes a toner which has remained on the surface of the latent image support, wherein the process cartridge is detachably mounted on an image forming apparatus.

13. An image forming method, comprising:

charging a latent image support;

forming an electrostatic latent image on a surface of the latent image support;

developing the electrostatic latent image formed on the surface of the latent image support with a toner to form a toner image;

transferring the toner image formed on the surface of the latent image support to a surface of a transfer-receiving material;

fixing the toner image; and detecting a concentration of the toner from a color difference between a reference toner image and the latent image support containing a phthalocyanine pigment and controlling a supply amount of the toner to the latent image support, wherein the toner is the electrostatic-image-developing toner according to claim 1.

14. An image forming apparatus, comprising:

a latent image support;

a charging unit that charges the latent image support;

an exposing unit that exposes the charged latent image support to form an electrostatic latent image on the latent image support;

a developing unit that develops the electrostatic latent image with a developer to form a toner image;

a transferring unit that transfers the toner image from the latent image support to a transfer-receiving material;

a fixing unit that fixes the toner image; and an image density controlling unit that detects a concentration of a toner from a color difference between a reference toner image and the latent image support containing a phthalocyanine pigment and controls a supply amount of the toner to the latent image support, wherein the electrostatic-image-developing toner according to claim 1 is used as the developer.

15. The image forming apparatus according to claim 14, wherein the transferring unit includes:

a primary transferring unit that transfers the toner image to an intermediate receiving material; and a secondary transferring unit that transfers the toner image from the intermediate receiving material to a recording medium.

* * * * *